US012791245B2

(12) United States Patent
Rucker et al.

(10) Patent No.: US 12,791,245 B2
(45) Date of Patent: Nov. 10, 2026

(54) CRYOGENIC APPARATUS

(71) Applicant: kiutra GmbH, Munich (DE)

(72) Inventors: Felix Rucker, Munich (DE); Jan Spallek, Munich (DE)

(73) Assignee: kiutra GmbH, Munich (DE)

( * ) Notice: Subject to any disclaimer, the term of this patent is extended or adjusted under 35 U.S.C. 154(b) by 329 days.

(21) Appl. No.: 18/386,821

(22) Filed: Nov. 3, 2023

(65) Prior Publication Data

US 2024/0151457 A1 May 9, 2024

(30) Foreign Application Priority Data

Nov. 5, 2022 (DE) ..... 102022129253.3

(51) Int. Cl.
*F25D 19/00* (2006.01)
*F25B 9/14* (2006.01)
*F28D 21/00* (2006.01)

(52) U.S. Cl.
CPC ..... *F25D 19/006* (2013.01); *F25B 9/14* (2013.01); *F28D 2021/0033* (2013.01)

(58) Field of Classification Search
CPC ..... F25D 19/006; F25D 2021/0033; F25B 9/14
See application file for complete search history.

(56) References Cited

U.S. PATENT DOCUMENTS 6,286,318 B1 * 9/2001 Maguire ..... F25B 9/145 62/6
10,704,809 B2 7/2020 Longsworth et al.
2010/0050661 A1 * 3/2010 Snow ..... F25B 9/14 62/51.1

FOREIGN PATENT DOCUMENTS

DE 697 32 443 T2 4/2006
WO 87/05990 A1 10/1987
WO WO-2017057760 A1 * 4/2017 ..... H01F 6/04

OTHER PUBLICATIONS

Extended European Search Report dated Apr. 8, 2024 received in European Application No. 23 20 7376.7.

* cited by examiner

*Primary Examiner* — Brian M King
(74) *Attorney, Agent, or Firm* — Ruggiero McAllister & McMahon LLC; Edward L McMahon

(57) ABSTRACT

The present disclosure relates to a cryogenic apparatus. The cryogenic apparatus includes a vacuum chamber; a cooling arrangement in the vacuum chamber; and a thermal interface arrangement at the vacuum chamber and configured to be cooled by the cooling arrangement.

17 Claims, 10 Drawing Sheets

CRYOGENIC APPARATUS

FIELD

The present disclosure relates to a cryogenic apparatus, a system having the cryogenic apparatus, and a method of handling and/or operating a cryogenic apparatus. More particularly, the present disclosure relates to a thermal interface that allows an external vacuum chamber to be connected to the cryogenic apparatus without breaching the vacuum in the external vacuum chamber.

BACKGROUND

Achieving a very high vacuum of less than $1 \cdot 10^{-9}$ mbar is required for various applications, e.g., for the construction of quantum computers based on trapped ions. This vacuum level can be achieved by pumping the vacuum vessel with turbomolecular pumps and increasing the temperature of the vessel to a temperature higher than 100° C. to accelerate the desorption of the gases. This process can take several weeks to reach the desired vacuum conditions.

Another technique is to pump down and cool the vessel or parts of the vessel to temperatures below 70K to increase the adsorption of gases on cold surfaces and thus increase the vacuum quality. To achieve even better vacuum quality, both techniques can be combined. However, this usually requires that the vacuum vessel be connected to the cryostat after baking, since many components in cryogenic systems cannot tolerate temperatures above 100° C. for extended periods, while the most efficient vacuum generation is achieved at temperatures above 150° C.

In view of the above, new cryogenic apparatuses, systems having the cryogenic apparatus, and methods of handling and/or operating a cryogenic apparatus, that overcome at least some of the problems in the art are beneficial.

SUMMARY

It is an object of the present disclosure to provide a cryogenic apparatus, a system having the cryogenic apparatus, and a method of handling and/or operating a cryogenic apparatus that can facilitate the providing of low temperatures within a vacuum chamber while maintaining high vacuum quality in the vacuum chamber. Another object of the present disclosure is to increase an operation efficiency of a cryogenic apparatus.

According to an independent aspect of the present disclosure, a cryogenic apparatus is provided. The cryogenic apparatus includes a vacuum chamber; a cooling arrangement in the vacuum chamber; and a thermal interface arrangement at (e.g., at an outside of) the vacuum chamber and configured to be cooled by the cooling arrangement.

According to some embodiments, which can be combined with other embodiments described herein, the cryogenic apparatus is connectable to an external vacuum chamber.

Preferably, the cryogenic apparatus is connectable to the external vacuum chamber in a state where a vacuum is present in the external vacuum chamber.

A vacuum is generally understood as a space essentially devoid of matter. The term "vacuum" as used throughout the present application is in particular understood as a technical vacuum, i.e., a region with a gaseous pressure much less than atmospheric pressure.

The vacuum inside the vacuum chamber can be high vacuum, ultra-high vacuum or extremely high vacuum (XHV). One or more vacuum generation sources, such as turbo pumps and/or cryo pumps and/or ion-getter pumps, can be connected to the vacuum chamber to generate the vacuum.

According to some embodiments, which can be combined with other embodiments described herein, the cryogenic apparatus is connectable to the external vacuum chamber which has a (second) thermal interface arrangement compatible with the (first) thermal interface arrangement of the cryogenic apparatus.

For example, when the cryogenic apparatus is connected to the external vacuum chamber, the thermal interface arrangement of the cryogenic apparatus is connected to (e.g., mechanically contacts) the thermal interface arrangement of the external vacuum chamber.

According to some embodiments, which can be combined with other embodiments described herein, the external vacuum chamber includes an object stage therein.

Preferably, when the cryogenic apparatus is connected to the external vacuum chamber, the thermal interface arrangement of the cryogenic apparatus is connected to the thermal interface arrangement of the external vacuum chamber to cool the object stage within the external vacuum chamber by operation of the cooling arrangement of the cryogenic apparatus.

The object stage inside the external vacuum chamber can be configured to support or hold one or more objects.

According to some embodiments, which can be combined with other embodiments described herein, the object is an ion trap. Generally, an ion trap uses electric fields and/or magnetic fields to capture ions. Ion traps can be used, for example, for the construction of quantum computers based on trapped ions ("trapped ion quantum computer").

In other embodiments, the object can be a sample. In this case, the object stage can also be referred to as "sample stage." The terms "object" and "sample" as used throughout the present disclosure include, but are not limited to, scientific materials, electronics (e.g., superconducting electronics), active devices, passive devices, processing units, and combinations thereof.

Preferably, the object is thermally connected to the object stage. For example, the object can be attached to the object stage by mechanical means such as clamps and/or screws, and/or can be glued to the object stage. The cryogenic apparatus can be configured to cool the object stage and thus the object to a temperature in range between 1K and 300K, particularly in a range between 4K and 300K. In some implementations, temperatures up to room temperature can be provided to conduct measurements and/or tests on the objects or to operate the objects, such as ion traps. Temperatures higher that room temperature can be provided using a heating arrangement.

According to some embodiments, which can be combined with other embodiments described herein, the cryogenic apparatus is connectable to the external vacuum chamber in a state where a vacuum is present in the vacuum chamber of the cryogenic apparatus.

According to some embodiments, which can be combined with other embodiments described herein, the cryogenic apparatus and the external vacuum chamber are detachable from each other in a state where the vacuum is present in the external vacuum chamber and/or in a state where the vacuum is present in the vacuum chamber of the cryogenic apparatus.

According to some embodiments, which can be combined with other embodiments described herein, the vacuum in the vacuum chamber of the cryogenic apparatus is a main thermal isolation vacuum.

According to some embodiments, which can be combined with other embodiments described herein, at least the cooling arrangement is fluidly immersed in the vacuum in the vacuum chamber of the cryogenic apparatus.

According to some embodiments, which can be combined with other embodiments described herein, at least the object stage is fluidly immersed in the vacuum in the external vacuum chamber.

According to some embodiments, which can be combined with other embodiments described herein, the vacuum chamber of the cryogenic apparatus is separate from the external vacuum chamber. Accordingly, the vacuum inside the vacuum chamber of the cryogenic apparatus and the vacuum inside the external vacuum chamber can be independent from each other.

Preferably, the vacuum chamber of the cryogenic apparatus and the external vacuum chamber do not have a common chamber wall. Accordingly, the vacuum inside the vacuum chamber of the cryogenic apparatus and the vacuum inside the external vacuum chamber can be independently established and maintained.

According to some embodiments, which can be combined with other embodiments described herein, the thermal interface arrangement of the cryogenic apparatus includes a first thermal interface connectable to a third thermal interface of the thermal interface arrangement of the external vacuum chamber to cool the object stage within the external vacuum chamber by operation of the cooling arrangement.

According to some embodiments, which can be combined with other embodiments described herein, the thermal interface arrangement of the cryogenic apparatus includes a second thermal interface connectable to a fourth thermal interface of the thermal interface arrangement of the external vacuum chamber.

According to some embodiments, which can be combined with other embodiments described herein, the first thermal interface, the second thermal interface, the third thermal interface and the fourth thermal interface include, or are made of, a material having a high thermal conductivity. For example, the first thermal interface, the second thermal interface, the third thermal interface and the fourth thermal interface can include, or be made of, a metal material, such as copper or brass.

According to some embodiments, which can be combined with other embodiments described herein, the second thermal interface is configured to be cooled by the cooling arrangement or another cooling arrangement of the cryogenic apparatus. For example, the first thermal interface can be connected to a first cooling arrangement (e.g., a pulse tube cooler) and the thermal interface can be connected to a second cooling arrangement (e.g., another pulse tube cooler or a second stage of a two-stage cooler).

Preferably, when the cryogenic apparatus is connected to the external vacuum chamber, the second thermal interface is connected to the fourth thermal interface of the external vacuum chamber to cool at least one element within the external vacuum chamber by operation of the cooling arrangement or the other cooling arrangement.

Preferably, the at least one element within the external vacuum chamber is a pre-cooling stage and/or a thermal shield.

According to some embodiments, which can be combined with other embodiments described herein, the first thermal interface and the second thermal interface are configured to be cooled to a first temperature and a second temperature, respectively.

Preferably, the first temperature and the second temperature are different.

Preferably, the first temperature is lower than the second temperature.

Preferably, the first temperature is 100K or below, 40 K or below, 4 K or below or 2K or below.

Additionally, or alternatively, the second temperature is 100K or below, 40 K or below, or 4K or below.

Preferably, the first temperature is 4K or below and the second temperature is 40K or below.

In an exemplary embodiment, the first temperature is between 1K and 5K (e.g., about 4K) and the second temperature is between 35K and 45K (e.g., about 40K).

According to some embodiments, which can be combined with other embodiments described herein, the cooling arrangement includes a cryogen-free system, such as a cryogen-free closed cycle system.

According to some embodiments, which can be combined with other embodiments described herein, the cooling arrangement includes a pulse tube cryocooler and/or an adiabatic demagnetization refrigerator and/or a Gifford-McMahon cryocooler and/or a Peltier cooler.

According to some embodiments, which can be combined with other embodiments described herein, the first thermal interface has a first surface configured to contact a third surface of the third thermal interface of the external vacuum chamber when the cryogenic apparatus is connected to the external vacuum chamber.

Preferably, the first surface of the first thermal interface is an essentially flat surface and/or an extended surface and/or an essentially horizontal surface and/or a top surface and/or has an essentially circular shape.

Additionally, or alternatively, the third surface of the third thermal interface is an essentially flat surface and/or an extended surface and/or an essentially horizontal surface and/or a bottom surface and/or has an essentially circular shape.

According to some embodiments, which can be combined with other embodiments described herein, the first thermal interface has at least one first contact element configured to contact the third thermal interface, such as a contact surface of the third thermal interface.

Preferably, the contact surface of the third thermal interface includes a vertical surface and/or a slanted surface.

Preferably, the at least one first contact element is arranged at a lateral side and/or a circumference of the first thermal interface.

Preferably, the at least one first contact element is a spring element.

According to some embodiments, which can be combined with other embodiments described herein, the first thermal interface is configured to contact at least one third contact element of the third thermal interface. In other words, the third thermal interface may include at least one third contact element. For example, a contact surface of the first thermal interface can be configured to contact the at least one third contact element of the third thermal interface.

Preferably, the contact surface of the first thermal interface includes a vertical surface and/or a slanted surface.

Preferably, the at least one third contact element is a spring element.

Preferably, the at least one third contact element is arranged at a lateral side and/or a circumference of the third thermal interface.

According to some embodiments, which can be combined with other embodiments described herein, the third thermal interface at least partially surrounds the first thermal interface.

According to some embodiments, which can be combined with other embodiments described herein, the first thermal interface and the second thermal interface of the cryogenic apparatus are located at different heights, e.g., along a longitudinal axis of the first thermal interface and/or the second thermal interface. The longitudinal axis can be a cylinder axis if the first thermal interface and/or the second thermal interface have a cylindrical shape.

Additionally, or alternatively, the third thermal interface and the fourth thermal interface of the external vacuum chambers are located at different heights, e.g., along a longitudinal axis of the third thermal interface and/or the fourth thermal interface. The longitudinal axis can be a cylinder axis if the third thermal interface and/or the fourth thermal interface have a cylindrical shape.

According to some embodiments, which can be combined with other embodiments described herein, the second thermal interface has at least one second contact element configured to contact the fourth thermal interface, such as a contact surface of the fourth thermal interface.

Preferably, the contact surface of the fourth thermal interface includes a vertical surface and/or a slanted surface.

Preferably, the at least one second contact element is arranged at a lateral side and/or a circumference of the second thermal interface.

Preferably, the at least one second contact element is a spring element.

According to some embodiments, which can be combined with other embodiments described herein, the second thermal interface is configured to contact at least one fourth contact element of the fourth thermal interface. In other words, the fourth thermal interface may include at least one fourth contact element. For example, a contact surface of the second thermal interface can be configured to contact the at least one fourth contact element of the fourth thermal interface.

Preferably, the contact surface of the second thermal interface includes a vertical surface and/or a slanted surface.

Preferably, the at least one fourth contact element is a spring element.

Preferably, the at least one fourth contact element is arranged at a lateral side and/or a circumference of the fourth thermal interface.

According to some embodiments, which can be combined with other embodiments described herein, the cryogenic apparatus includes a first support structure supporting the first thermal interface.

Preferably, the first support structure supports the first thermal interface from below. For example, the first thermal interface can be attached to a top side of the first support structure.

Preferably, the first support structure is connected to the second thermal interface to support the first thermal interface. In particular, a first end of the first support structure can be connected to the first thermal interface and a second end of the first support structure opposite the first end can be connected to the second thermal interface.

Additionally, or alternatively, the first support structure has a low thermal conductivity. For example, the first support structure can have a thermal conductivity of 1 W/(Km) or less, or 0.5 W/(Km) or less.

Additionally, or alternatively, the first support structure has a cylindrical shape. For example, the first support structure may be a hollow cylinder. In some embodiments, the first thermal interface can close off an upper side of the hollow cylinder, particularly essentially vacuum-tight.

Additionally, or alternatively, the first support structure includes, or is, a membrane.

Additionally, or alternatively, the first support structure, such as the membrane, has a thickness of 0.5 mm or less, or 0.2 mm or less.

Additionally, or alternatively, the first support structure includes one or more reinforcement ribs. For example, the one or more reinforcement ribs can extend around a circumference of the first support structure, in particular horizontally.

Additionally, or alternatively, the first support structure includes, or is made of, a metal material, such as stainless steel. In other embodiments, the first support structure can be made of glass fiber reinforced plastics.

Additionally, or alternatively, the first support structure is formed as a single piece.

Additionally, or alternatively, the first support structure is essentially vacuum-tight (particularly in combination with other walls and/or apparatus parts). For example, the first support structure may seal the vacuum inside the vacuum chamber of the cryogenic apparatus from an outside essentially vacuum-tight.

Preferably, the first support structure provides, or is, a wall of the vacuum chamber of the cryogenic apparatus.

According to some embodiments, which can be combined with other embodiments described herein, the cryogenic apparatus includes a second support structure supporting the second thermal interface.

Preferably, the second support structure is connected to the vacuum chamber of the cryogenic apparatus or another part thereof to support the second thermal interface.

In some embodiments, a first end of the second support structure can be connected to the vacuum chamber of the cryogenic apparatus or another part thereof and a second end of the second support structure opposite the first end can be connected to the second thermal interface.

Additionally, or alternatively, the second support structure has a low thermal conductivity. For example, the second support structure can have a thermal conductivity of 1 W/(Km) or less, or 0.5 W/(Km) or less.

Additionally, or alternatively, the second support structure has a cylindrical shape.

For example, the second support structure may be a hollow cylinder. In some embodiments, the second support structure can be arranged in an interior space of the second support structure. In another embodiment, the second support structure can be arranged above the second support structure.

Additionally, or alternatively, the second support structure includes, or is, a membrane.

Additionally, or alternatively, the second support structure, such as the membrane, has a thickness of 0.5 mm or less, or 0.2 mm or less.

Additionally, or alternatively, the second support structure includes one or more reinforcement ribs. For example, the one or more reinforcement ribs can extend around a circumference of the second support structure, in particular horizontally.

Additionally, or alternatively, the second support structure includes, or is made of, a metal material, such as stainless steel. In other embodiments, the second support structure can be made of glass fiber reinforced plastics.

Additionally, or alternatively, the second support structure is formed as a single piece.

Additionally, or alternatively, the second support structure is essentially vacuum-tight (particularly in combination with other walls and/or apparatus parts). For example, the second support structure may seal the vacuum inside the vacuum chamber of the cryogenic apparatus from an outside essentially vacuum-tight.

Preferably, the second support structure provides, or is, a wall of the vacuum chamber of the cryogenic apparatus.

According to some embodiments, which can be combined with other embodiments described herein, the thermal interface arrangement of the external vacuum chamber includes a third support structure supporting the third thermal interface.

Preferably, the third support structure supports the third thermal interface from below. For example, the third thermal interface can be attached to a top side of the third support structure.

Preferably, the third support structure is connected to the fourth thermal interface to support the third thermal interface. In particular, a first end of the third support structure can be connected to the third thermal interface and a second end of the third support structure opposite the first end can be connected to the fourth thermal interface.

Additionally, or alternatively, the third support structure has a low thermal conductivity. For example, the third support structure can have a thermal conductivity of 1 W/(Km) or less, or 0.5 W/(Km) or less.

Additionally, or alternatively, the third support structure has a cylindrical shape.

For example, the third support structure may be a hollow cylinder. In some embodiments, the third thermal interface can close off an upper side of the hollow cylinder, particularly essentially vacuum-tight.

Additionally, or alternatively, the third support structure includes, or is, a membrane.

Additionally, or alternatively, the third support structure, such as the membrane, has a thickness of 0.5 mm or less, or 0.2 mm or less.

Additionally, or alternatively, the third support structure includes one or more reinforcement ribs. For example, the one or more reinforcement ribs can extend around a circumference of the third support structure, in particular horizontally.

Additionally, or alternatively, the third support structure includes, or is made of, a metal material, such as stainless steel. In other embodiments, the third support structure can be made of glass fiber reinforced plastics.

Additionally, or alternatively, the third support structure is formed as a single piece.

Additionally, or alternatively, the third support structure is essentially vacuum-tight (particularly in combination with other walls and/or apparatus parts). For example, the third support structure may seal the vacuum inside the external vacuum chamber from an outside essentially vacuum-tight.

Preferably, the third support structure provides, or is, a wall of the external vacuum chamber.

According to some embodiments, which can be combined with other embodiments described herein, the thermal interface arrangement of the external vacuum chamber includes a fourth support structure supporting the fourth thermal interface.

Preferably, the fourth support structure is connected to the external vacuum chamber, such as a flange thereof, to support the fourth thermal interface, e.g., in a suspended state. In particular, a first end of the fourth support structure can be connected to the external vacuum chamber, such as a flange thereof, and a second end of the fourth support structure opposite the first end can be connected to the fourth thermal interface.

Additionally, or alternatively, the fourth support structure has a low thermal conductivity. For example, the fourth support structure can have a thermal conductivity of 1 W/(Km) or less, or 0.5 W/(Km) or less.

Additionally, or alternatively, the fourth support structure has a cylindrical shape.

For example, the fourth support structure may be a hollow cylinder. In some embodiments, the third support structure can be arranged in an interior space of the fourth support structure.

Additionally, or alternatively, the fourth support structure includes, or is, a membrane.

Additionally, or alternatively, the fourth support structure, such as the membrane, has a thickness of 0.5 mm or less, or 0.2 mm or less.

Additionally, or alternatively, the fourth support structure includes one or more reinforcement ribs. For example, the one or more reinforcement ribs can extend around a circumference of the fourth support structure, in particular horizontally.

Additionally, or alternatively, the fourth support structure includes, or is made of, a metal material, such as stainless steel. In other embodiments, the fourth support structure can be made of glass fiber reinforced plastics.

Additionally, or alternatively, the fourth support structure is formed as a single piece.

Additionally, or alternatively, the fourth support structure is essentially vacuum-tight (particularly in combination with other walls and/or apparatus parts). For example, the fourth support structure may seal the vacuum inside the external vacuum chamber from an outside essentially vacuum-tight.

Preferably, the fourth support structure provides, or is, a wall of the external vacuum chamber.

According to some embodiments, which can be combined with other embodiments described herein, the fourth thermal interface and/or an extension thereof extends between the third support structure and the fourth support structure from a bottom side to a top side of the thermal interface arrangement. In some embodiments, the fourth thermal interface and/or the extension which extends between the third support structure and the fourth support structure can provide a thermal shield.

According to some embodiments, which can be combined with other embodiments described herein, when the cryogenic apparatus is connected to the external vacuum chamber, the first support structure, the second support structure, the third support structure and the fourth support structure are concentrically arranged, e.g., concentrically nested. For example, the support structures can be arranged in the following order (from the inside to the outside): first support structure, third support structure, fourth support structure and second support structure.

According to some embodiments, which can be combined with other embodiments described herein, the first thermal interface extends to an outside of the vacuum chamber of the cryogenic apparatus.

Preferably, the first thermal interface is exposed to the outside of the vacuum chamber of the cryogenic apparatus in a state where the external vacuum chamber is not connected to the cryogenic apparatus.

According to some embodiments, which can be combined with other embodiments described herein, the second thermal interface extends to an outside of the vacuum chamber of the cryogenic apparatus.

Preferably, the second thermal interface is exposed to the outside of the vacuum chamber of the cryogenic apparatus in a state where the external vacuum chamber is not connected to the cryogenic apparatus.

According to some embodiments, which can be combined with other embodiments described herein, the third thermal interface extends to an outside of the external vacuum chamber.

Preferably, the third thermal interface is exposed to the outside of the external vacuum chamber in a state where the external vacuum chamber is not connected to the cryogenic apparatus.

According to some embodiments, which can be combined with other embodiments described herein, the fourth thermal interface extends to an outside of the external vacuum chamber.

Preferably, the fourth thermal interface is exposed to the outside of the external vacuum chamber in a state where the external vacuum chamber is not connected to the cryogenic apparatus.

According to some embodiments, which can be combined with other embodiments described herein, the cryogenic apparatus includes at least one first electrical interface at the vacuum chamber. The at least one first electrical interface can be configured to be connected to at least one second electrical interface of the external vacuum chamber when the cryogenic apparatus is connected to the external vacuum chamber.

In some embodiments, the at least one first electrical interface and the at least one second electrical interface are self-centering interfaces. For example, the cryogenic apparatus may include a first guiding structure configured to guide a second guiding structure of the external vacuum chamber during a connection process of the cryogenic apparatus and the external vacuum chamber. The first guiding structure and the second guiding structure can provide the self-centering function by guiding the at least one first electrical interface and the at least one second electrical interface to connect them in a defined position.

Preferably, the at least one first electrical interface includes at least one of a DC interface and an RF interface.

Preferably, the at least one second electrical interface includes at least one of a DC interface and an RF interface.

Preferably, the at least one first electrical interface and the at least one second electrical interface are used for controlling an object inside the external vacuum chamber.

Additionally, or alternatively, the at least one first electrical interface and the at least one second electrical interface are used for performing and/or controlling an object measurement inside the external vacuum chamber.

According to some embodiments, which can be combined with other embodiments described herein, the cryogenic apparatus includes at least one first optical interface at the vacuum chamber, The at least one first optical interface can be configured to be connected to at least one second optical interface of the external vacuum chamber when the cryogenic apparatus is connected to the external vacuum chamber.

Preferably, the at least one first optical interface and the at least one second optical interface are configured for performing optical measurements and/or tests on the object inside the external vacuum chamber. In some embodiments, the optical measurements and/or tests may use optical beams, such as laser beams.

According to some embodiments, which can be combined with other embodiments described herein, when the cryogenic apparatus has been connected to the external vacuum chamber and optionally during a connection process, an intermediate space is formed between the thermal interface arrangement of the cryogenic apparatus and the thermal interface arrangement of the external vacuum chamber.

Preferably, the intermediate space between the thermal interface arrangement of the cryogenic apparatus and the thermal interface arrangement of the external vacuum chamber is sealed essentially vacuum-tight when the cryogenic apparatus has been connected to the external vacuum chamber and optionally during the connection process.

Preferably, a bellows is connectable between the thermal interface arrangement of the cryogenic apparatus and the thermal interface arrangement of the external vacuum chamber to seal or close the intermediate space between the thermal interface arrangement of the cryogenic apparatus and the thermal interface arrangement of the external vacuum chamber essentially vacuum-tight.

Preferably, at least one pumping port is provided at the intermediate space between the thermal interface arrangement of the cryogenic apparatus and the thermal interface arrangement of the external vacuum chamber.

Preferably, at least one pump is connectable to the at least one pumping port to establish a vacuum in the intermediate space between the thermal interface arrangement of the cryogenic apparatus and the thermal interface arrangement of the external vacuum chamber.

According to some embodiments, which can be combined with other embodiments described herein, the cryogenic apparatus includes a valve configured to close a first space in which the thermal interface arrangement of the cryogenic apparatus is located.

Preferably, the valve provides at least one pumping port.

The valve may be closed when the cryogenic apparatus is disconnected from the external vacuum chamber. For example, a vacuum can be established in the first space in which the thermal interface arrangement of the cryogenic apparatus is located when the valve is closed.

The valve may be opened after the external vacuum chamber has been attached to the cryogenic apparatus so that the thermal interface arrangement of the external vacuum chamber can extend through the open valve for being connected to the thermal interface arrangement of the cryogenic apparatus.

For example, the valve can be closed, and a vacuum can be established or maintained in the first space in which the thermal interface arrangement of the cryogenic apparatus is located. The external vacuum chamber can be attached to the cryogenic apparatus and another vacuum can be established in a second space in which the thermal interface arrangement of the external vacuum chamber is located. Thereafter, the valve can be opened to connect the first space and the second space. The thermal interface arrangement of the external vacuum chamber then can be moved through the open valve for connection with the thermal interface arrangement of the cryogenic apparatus.

Preferably, the first space in which the thermal interface arrangement of the cryogenic apparatus is located and the second space in which the thermal interface arrangement of the external vacuum chamber is located form the intermediate space described above.

According to some embodiments, which can be combined with other embodiments described herein, a bellows is connectable between the valve and the thermal interface arrangement of the external vacuum chamber to seal the second space in which the thermal interface arrangement of the external vacuum chamber is located.

According to some embodiments, which can be combined with other embodiments described herein, the cryogenic apparatus is connectable to the external vacuum chamber by a linear motion.

Preferably, the linear motion is a linear motion of the external vacuum chamber with respect to the cryogenic apparatus, which is stationary, i.e., not moving.

According to some embodiments, which can be combined with other embodiments described herein, the cryogenic apparatus is connectable to the external vacuum chamber without rotary movement. For example, the cryogenic apparatus is connectable to the external vacuum chamber by moving only linearly.

According to some embodiments, which can be combined with other embodiments described herein, the cryogenic apparatus is connectable to the external vacuum chamber in a state where the cooling arrangement is operated.

According to some embodiments, which can be combined with other embodiments described herein, the cryogenic apparatus includes one or more holding means configured to fix a relative position between the cryogenic apparatus and the external vacuum chamber when the cryogenic apparatus is connected to the external vacuum chamber.

Preferably, the relative position is fixed in a direction of the linear motion.

Preferably, the one or more holding means include at least one of a hole, a threaded hole, a screw, a spring and a clamp.

According to some embodiments, which can be combined with other embodiments described herein, the cryogenic apparatus includes a first guiding structure configured to guide a second guiding structure of the external vacuum chamber during a connection process of the cryogenic apparatus and the external vacuum chamber. The first guiding structure and the second guiding structure can provide a self-centering function to connect the thermal interface arrangement of the cryogenic apparatus and the thermal interface arrangement of the external vacuum chamber (and optionally the at least one first electrical interface and the at least one second electrical interface) in a defined position.

According to some embodiments, which can be combined with other embodiments described herein, the cryogenic apparatus includes a heating arrangement, wherein, when the cryogenic apparatus is connected to the external vacuum chamber, the thermal interface arrangement of the cryogenic apparatus (e.g., the first thermal interface) is connected to the thermal interface arrangement of the external vacuum chamber (e.g., the third thermal interface) to heat the object stage within the external vacuum chamber by operation of the heating arrangement.

According to some embodiments, which can be combined with other embodiments described herein, the external vacuum chamber includes a magnet device configured to apply a magnetic field to the object.

Preferably, the magnet device includes at least one superconducting magnet and/or at least one (conventional or resistive) electromagnet and/or at least permanent magnet.

According to another independent aspect of the present disclosure, a system is provided. The system includes the cryogenic apparatus and the external vacuum chamber of the embodiments of the present disclosure.

According to another independent aspect of the present disclosure, a vacuum chamber is provided. The vacuum chamber can be configured like the external vacuum chamber described above.

According to some embodiments, which can be combined with other embodiments described herein, the vacuum chamber is heatable to temperatures of 100° C. or higher, such as of 150° C. or higher.

According to another independent aspect of the present disclosure, a thermal interface arrangement for a cryogenic apparatus is provided. The thermal interface arrangement can be configured like the thermal interface arrangement of the cryogenic apparatus described above.

According to another independent aspect of the present disclosure, a thermal interface arrangement for a vacuum chamber is provided. The thermal interface arrangement can be configured like the thermal interface arrangement of the external vacuum chamber described above.

According to another independent aspect of the present disclosure, a method of handling and/or operating a cryogenic apparatus is provided. The method includes performing a linear motion of an external vacuum chamber towards a cryogenic apparatus to bring a thermal interface arrangement of the cryogenic apparatus in contact with a thermal interface arrangement of the external vacuum chamber in a state where a vacuum is present in the external vacuum chamber; and operating a cooling arrangement of the cryogenic apparatus to cool the thermal interface arrangement of the cryogenic apparatus, wherein an object stage within the external vacuum chamber is cooled by operation of the cooling arrangement and via the thermal interface arrangement of the cryogenic apparatus.

Further aspects, benefits, and features of the present disclosure are apparent from the claims, the description, and the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments. The accompanying drawings relate to embodiments of the disclosure and are described in the following.

DETAILED DESCRIPTION OF EMBODIMENTS

Figure 1A:
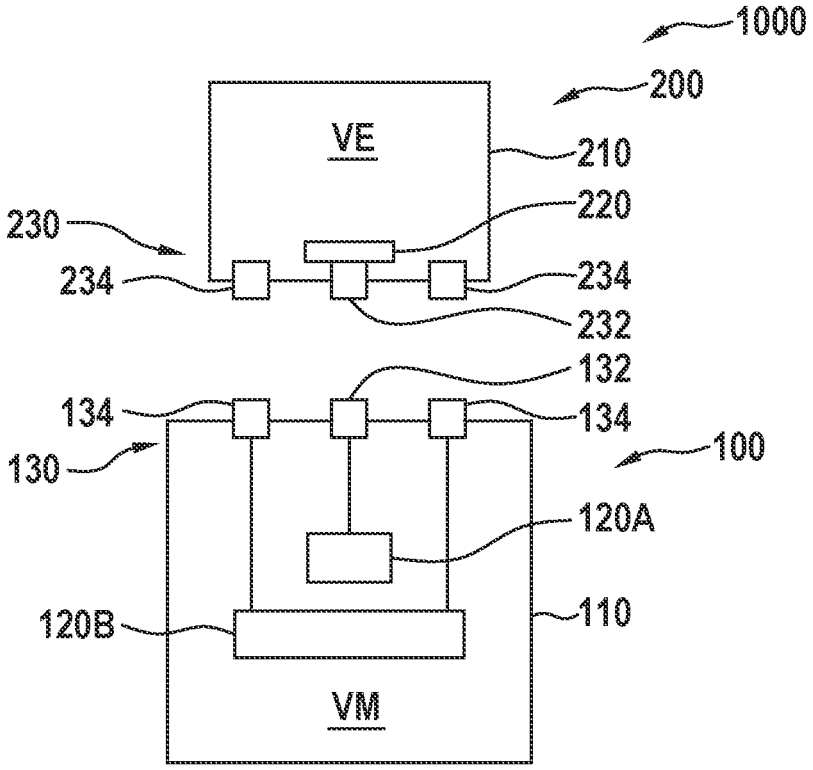
FIG. 1A shows a schematic view of a cryogenic apparatus and an external vacuum chamber in a disconnected state according to embodiments described herein.

Reference will now be made in detail to the various embodiments of the disclosure, one or more examples of which are illustrated in the figures. Within the following description of the drawings, the same reference numbers refer to same components. Generally, only the differences with respect to individual embodiments are described. Each example is provided by way of explanation of the disclosure and is not meant as a limitation of the disclosure. Further, features illustrated or described as part of one embodiment can be used on or in conjunction with other embodiments to yield yet a further embodiment. It is intended that the description includes such modifications and variations.

Achieving a very high vacuum of less than $1 \cdot 10^{-9}$ mbar is required for various applications, e.g., for the construction of quantum computers based on trapped ions. This vacuum level can be achieved by pumping the vacuum vessel with turbomolecular pumps and increasing the temperature of the vessel to a temperature higher than 100° C. to accelerate the desorption of the gases. Another technique is to pump down and cool the vessel or parts of the vessel to temperatures below 70K to increase the adsorption of gases on cold surfaces and thus increase the vacuum quality. To achieve even better vacuum quality, both techniques can be combined. However, these processes can take several weeks to reach the desired vacuum conditions.

The embodiments of the present disclosure overcome the above drawbacks by providing the cryogenic apparatus with a thermal interface which allows to flexibly attach external vacuum chambers with objects, such as samples or ion traps, thereto. In particular, the external vacuum chamber can be prepared at a remote location to reach desired vacuum conditions therein. For example, a high vacuum level can be achieved inside the external vacuum chamber by pumping the external vacuum chamber with turbomolecular pumps and increasing the temperature to a temperature higher than, for example, 100° C. ("baking"). After the desired vacuum conditions have been reached, the external vacuum chamber can be connected to the cryogenic apparatus without breaking the vacuum inside the external vacuum chamber.

In view of the above, the cryogenic apparatus is not involved in the time-consuming process of achieving high vacuum levels within the external vacuum chamber containing, for example, a scientific sample or an ion trap. Consequently, the operating efficiency of the cryogenic apparatus can be improved. For example, multiple external vacuum chambers can be prepared remotely, with an external vacuum chamber attached to the cryogenic apparatus only during measurement or testing processes and not during vacuum preparation. In addition, the external vacuum chamber may contain only components that can be heated to temperatures of 100° C. or higher to achieve high vacuum levels. Such a baking process is often not possible with cryogenic apparatuses because some components thereof cannot be heated to such high temperatures without damaging or even destroying them.

Figure 1B:
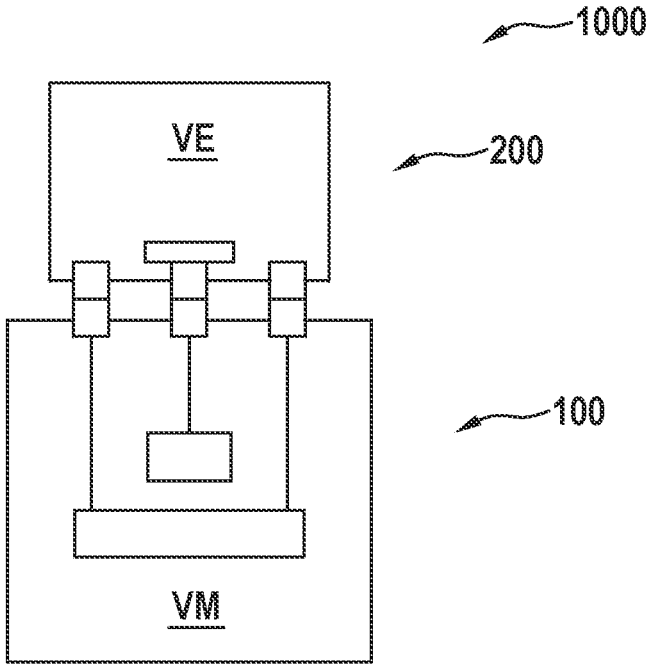
FIG. 1B shows a schematic view of the cryogenic apparatus and the external vacuum chamber of FIG. 1A in a connected state according to embodiments described herein.

FIG. 1A shows a schematic view of a system 1000 including a cryogenic apparatus 100 and an external vacuum chamber 200 in a disconnected state according to embodiments described herein. FIG. 1B shows a schematic view of the system 1000 of FIG. 1A in a connected state.

The cryogenic apparatus 100 includes a vacuum chamber 110; a cooling arrangement 120A, 120B in the vacuum chamber 110; and a thermal interface arrangement 130 at the vacuum chamber 110 and configured to be cooled by the cooling arrangement 120A, 120B. In particular, the thermal interface arrangement 130 can be mechanically and thus thermally connected to the cooling arrangement 120A, 120B to cool the thermal interface arrangement 130.

The cryogenic apparatus 100 is releasably connectable to the external vacuum chamber 200. This can facilitate the providing of low temperatures within the external vacuum chamber 200 while maintaining high vacuum quality in the external vacuum chamber 200. Consequently, also an operation efficiency of the cryogenic apparatus 100 can be increased.

In some embodiments, the cryogenic apparatus 100 is connectable to the external vacuum chamber 200 in a state where a vacuum VE is present in the external vacuum chamber 200, for instance in a vacuum vessel 210 of the external vacuum chamber 200. The vacuum VE inside the external vacuum chamber 200 can be high vacuum, ultra-high vacuum or extremely high vacuum. One or more vacuum generation sources, such as turbo pumps and/or cryo pumps (not shown), can be connected to the external vacuum chamber 200 to generate the vacuum VE.

Optionally, the cryogenic apparatus 100 is connectable to the external vacuum chamber 200 in a state where a vacuum VM, such as a main thermal isolation vacuum, is present in the vacuum chamber 110 of the cryogenic apparatus 100. The vacuum VM inside the vacuum chamber 110 can be high vacuum or ultra-high vacuum. One or more vacuum generation sources, such as turbo pumps and/or cryo pumps (not shown), can be connected to the vacuum chamber 110 to generate the vacuum VM.

At least the cooling arrangement 120A, 120B can be located directly in the vacuum VM inside the vacuum chamber 110. In particular, the cooling arrangement 120A, 120B can be fluidly immersed in the vacuum VM in the vacuum chamber 110 of the cryogenic apparatus 100.

In some embodiments, the cryogenic apparatus 100 and the external vacuum chamber 200 can be detachable from each other in a state where the vacuum VE is present in the external vacuum chamber 200 and/or in a state where the vacuum VM is present in the vacuum chamber 110 of the cryogenic apparatus 100.

The vacuum chamber 110 of the cryogenic apparatus 100 and the external vacuum chamber 200 are separate from each other and do not share a common chamber wall.

Accordingly, the vacuum VM inside the vacuum chamber 110 of the cryogenic apparatus 100 and the vacuum VE inside the external vacuum chamber 200 can be independently established and maintained.

According to some embodiments, the external vacuum chamber 200 includes an object stage 220 therein. The object stage 220 can be fluidly immersed in the vacuum VE in the external vacuum chamber 200. The object stage 200 can be configured to support or hold one or more objects, such as an ion trap or sample. Preferably, the object is thermally connected to the object stage 220. For example, the object can be attached to the object stage 220 by mechanical means such as clamps and/or screws, and/or can be glued to the object stage.

In exemplary but non-limiting embodiments, the external vacuum chamber 200 can include a magnet device (not shown) configured to apply a magnetic field to the object. Preferably, the magnet device includes at least one superconducting magnet and/or at least one (conventional or resistive) electromagnet and/or at least permanent magnet.

The cryogenic apparatus 100 includes the thermal interface arrangement 130 configured to be cooled by the cooling arrangement 120A, 120B. The external vacuum chamber 200 includes another thermal interface arrangement 230 which is compatible with the thermal interface arrangement 130 of the cryogenic apparatus 100.

In particular, when the cryogenic apparatus 100 is connected to the external vacuum chamber 200, the thermal interface arrangement 130 of the cryogenic apparatus 100 is mechanically and thus thermally connected to the thermal interface arrangement 230 of the external vacuum chamber 200 to cool the object stage 220 within the external vacuum chamber 200 by operation of the cooling arrangement of the cryogenic apparatus 100.

In some embodiments, the cryogenic apparatus 100 can be configured to cool the object stage 220 and thus the object to a temperature in range between 1K and 300K, particularly in a range between 4K and 300K. In some implementations, temperatures up to room temperature or even higher can be provided to conduct measurements and/or tests on the objects or to operate the objects, such as ion traps.

Optionally, the cryogenic apparatus 100 can include a heating arrangement (not shown) configured to heat the thermal interface arrangement 130 of the cryogenic apparatus 100. When the cryogenic apparatus 100 is connected to the external vacuum chamber 200, the thermal interface arrangement 130 of the cryogenic apparatus 100 can be connected to the thermal interface arrangement 230 of the external vacuum chamber 200 to heat the object stage 220 within the external vacuum chamber 200 by operation of the heating arrangement of the cryogenic apparatus 100.

In some embodiments, the thermal interface arrangement 130 of the cryogenic apparatus 100 includes a first thermal interface 132 connectable to a third thermal interface 232 of the thermal interface arrangement 230 of the external vacuum chamber 200 to cool the object stage 220 within the external vacuum chamber 200 by operation of the cooling arrangement 120A, 120B.

Optionally, the thermal interface arrangement 130 of the cryogenic apparatus 100 may include a second thermal interface 134 connectable to a fourth thermal interface 234 of the thermal interface arrangement 230 of the external vacuum chamber 230.

According to some embodiments, which can be combined with other embodiments described herein, the second thermal interface 134 is configured to be cooled by the cooling arrangement or another cooling arrangement of the cryogenic apparatus. In the example of FIGS. 1A and 1B, a first cooling arrangement 120A is configured to cool the first thermal interface 132, and a second cooling arrangement 120B is configured to cool the second thermal interface 134.

Preferably, when the cryogenic apparatus 100 is connected to the external vacuum chamber 200, the second thermal interface 134 is connected to the fourth thermal interface 234 of the external vacuum chamber 200 to cool at least one element within the external vacuum chamber 200 by operation of the cooling arrangement or the other cooling arrangement. The at least one element within the external vacuum chamber 200 can be a pre-cooling stage and/or a thermal shield but is not limited thereto.

The first thermal interface 132 and the second thermal interface 134 can be configured to be cooled to a first temperature and a second temperature, respectively. Preferably, the first temperature is lower than the second temperature. For example, the first temperature is 100K or below, 40 K or below, 4 K or below, or 2K or below. Additionally, or alternatively, the second temperature is 100K or below, 40 K or below, or 4K or below. In an exemplary embodiment, the first temperature can be between 1K and 5K (e.g., about 4K) and the second temperature can be between 35K and 45K (e.g., 40K).

According to some embodiments, which can be combined with other embodiments described herein, the cooling arrangement, such as the first cooling arrangement 120A and the second cooling arrangement 120AB, includes a cryogen-free closed cycle system. For example, the cooling arrangement, such as the first cooling arrangement 120A and the second cooling arrangement 120AB, may include a pulse tube cryocooler.

According to some embodiments, the cryogenic apparatus 100 can include at least one first electrical interface at the vacuum chamber 110 and configured to be connected to at least one second electrical interface of the external vacuum chamber 200 when the cryogenic apparatus 100 is connected to the external vacuum chamber 200. The at least one first electrical interface may include at least one of a DC interface and an RF interface. Likewise, the at least one second electrical interface can include at least one of a DC interface and an RF interface.

Additionally, or alternatively, the cryogenic apparatus 100 can include at least one first optical interface at the vacuum chamber 110 and configured to be connected to at least one second optical interface of the external vacuum chamber 200 when the cryogenic apparatus is connected to the external vacuum chamber. The at least one first optical interface and the at least one second optical interface can be configured for performing optical measurements and/or tests on the object(s) inside the external vacuum chamber.

According to some embodiments, the cryogenic apparatus 100 is connectable to the external vacuum chamber 200 by a linear motion. The linear motion may be a linear motion of the external vacuum chamber 200 with respect to the cryogenic apparatus 100, which is stationary, i.e., not moving. The cryogenic apparatus 100 may be connectable to the external vacuum chamber 200 without rotary movement. For example, the cryogenic apparatus 100 can be connectable to the external vacuum chamber 200 by moving only linearly.

In some embodiments, the cryogenic apparatus includes one or more holding means (not shown) configured to fix a relative position between the cryogenic apparatus 100 and the external vacuum chamber 200 when the cryogenic apparatus 100 is connected to the external vacuum chamber 200. Preferably, the one or more holding means include at least one of a hole, a threaded hole, a screw, a spring and a clamp.

According to some embodiments, the cryogenic apparatus 100 includes a first guiding structure (not shown) configured to guide a second guiding structure (not shown) of the external vacuum chamber 200 during a connection process of the cryogenic apparatus 100 and the external vacuum chamber 200. The first guiding structure and the second guiding structure can provide a self-centering function to connect the thermal interface arrangement of the cryogenic apparatus 100 and the thermal interface arrangement of the external vacuum chamber 200 (and optionally electrical interfaces of the cryogenic apparatus 100 and the external vacuum chamber 200) in a defined position.

Figure 2:
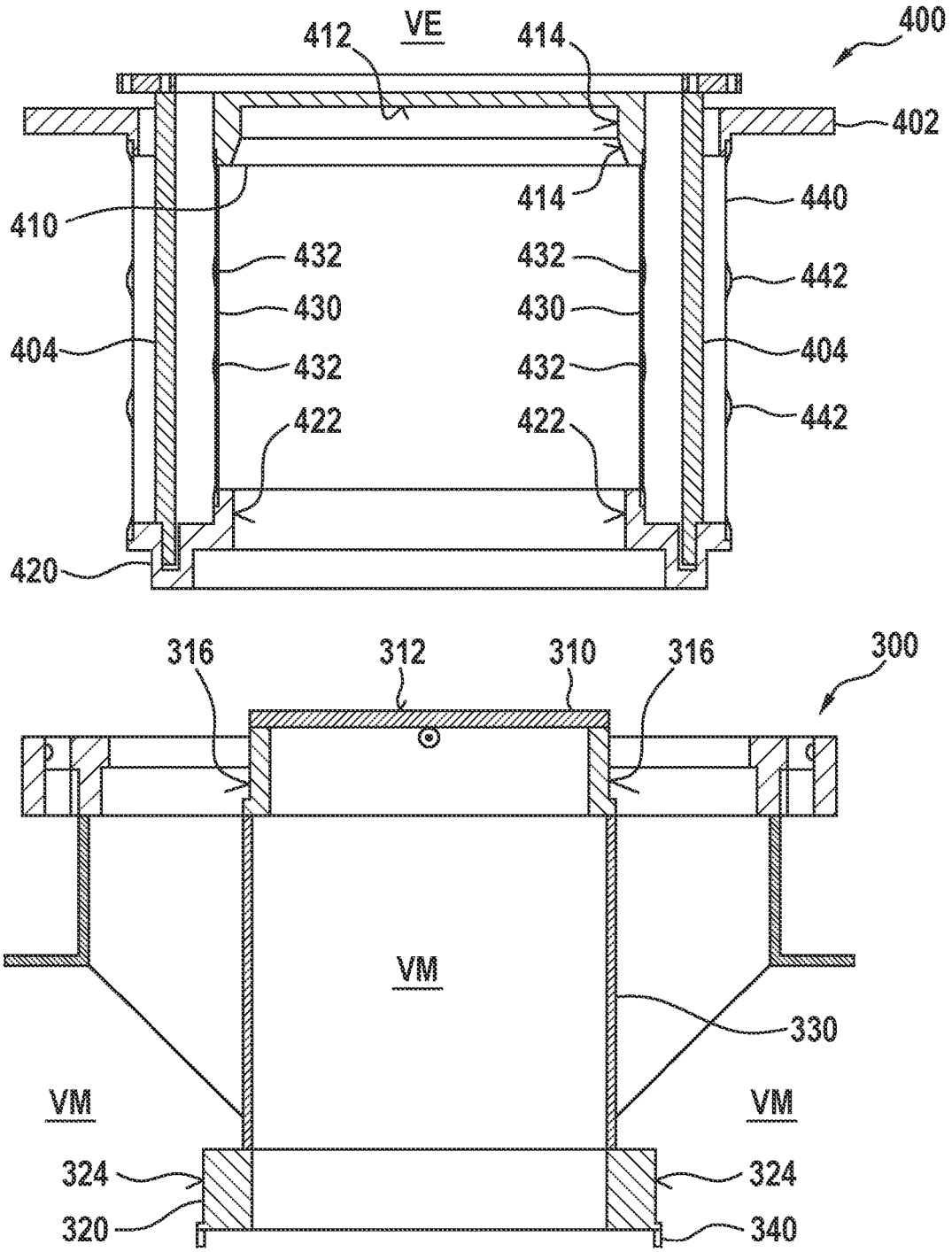
FIG. 2 shows a cross-sectional view of a thermal interface arrangement of a cryogenic apparatus and a thermal interface arrangement of an external vacuum chamber in a disconnected state according to embodiments described herein.
Figure 3:
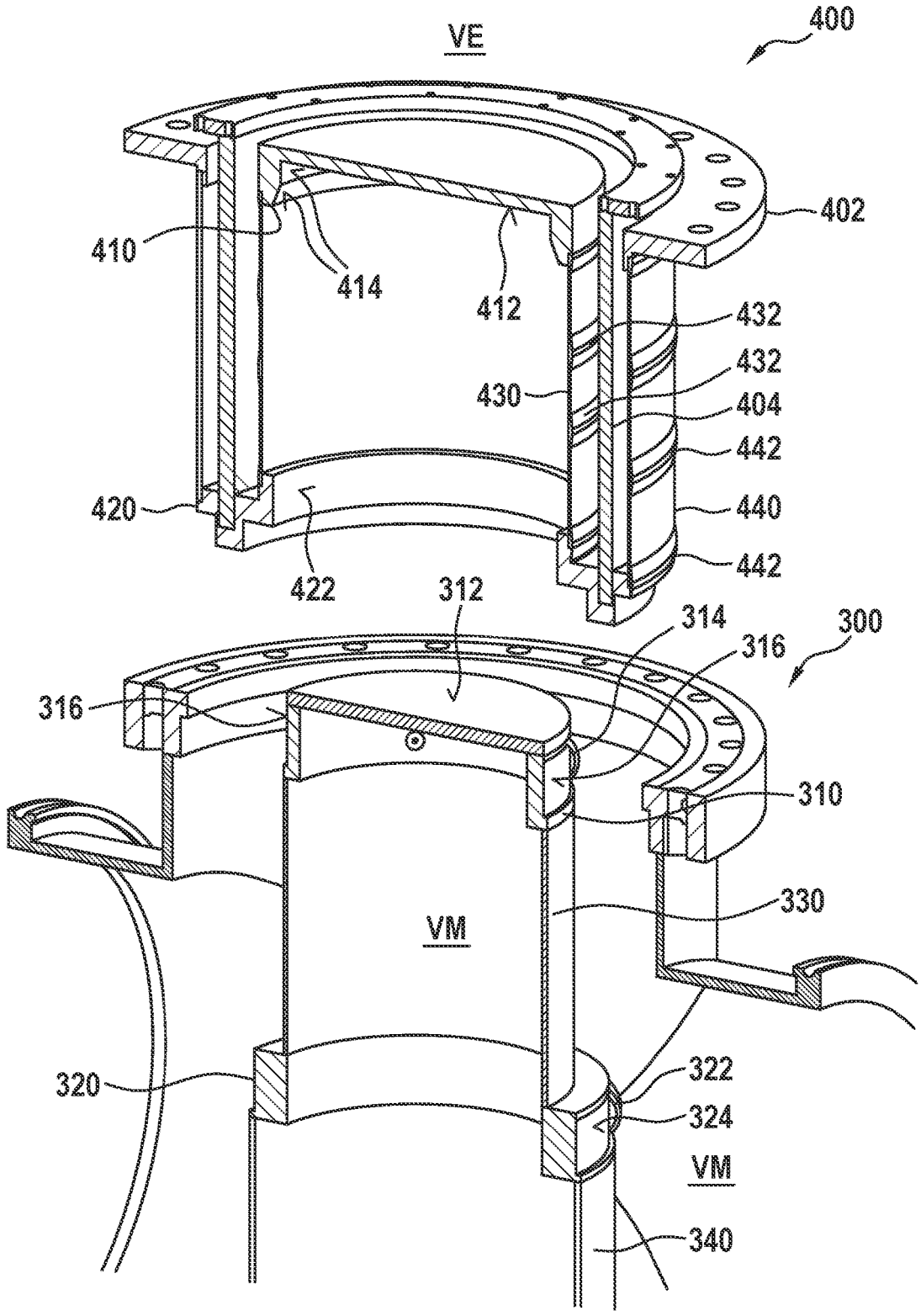
FIG. 3 shows a perspective view of the thermal interface arrangement of the cryogenic apparatus and the thermal interface arrangement of the external vacuum chamber of FIG. 2 in a disconnected state.
Figure 4:
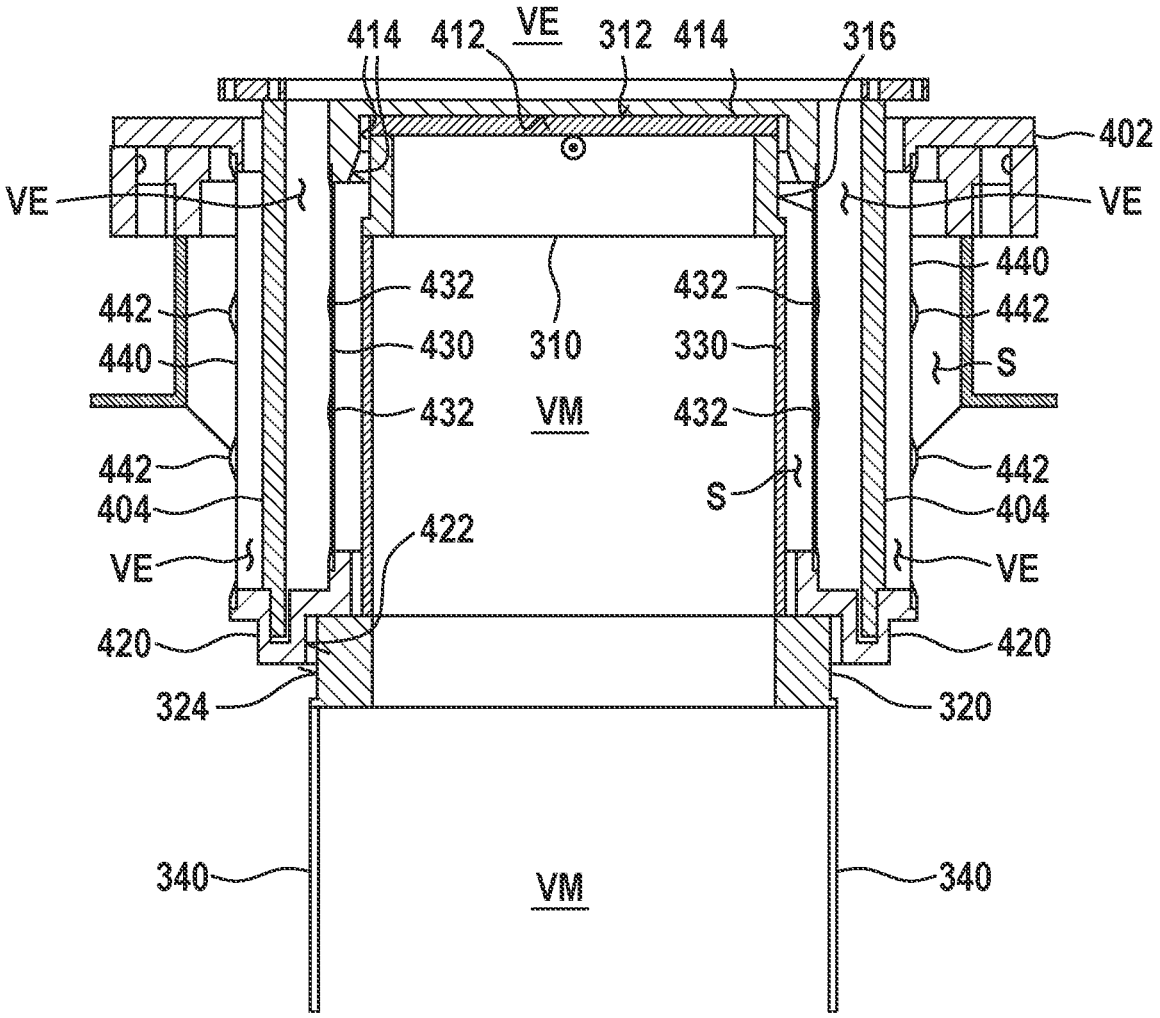
FIG. 4 shows a cross-sectional view of the thermal interface arrangement of the cryogenic apparatus and the thermal interface arrangement of the external vacuum chamber of FIGS. 2 and 3 in a connected state.
Figure 5:
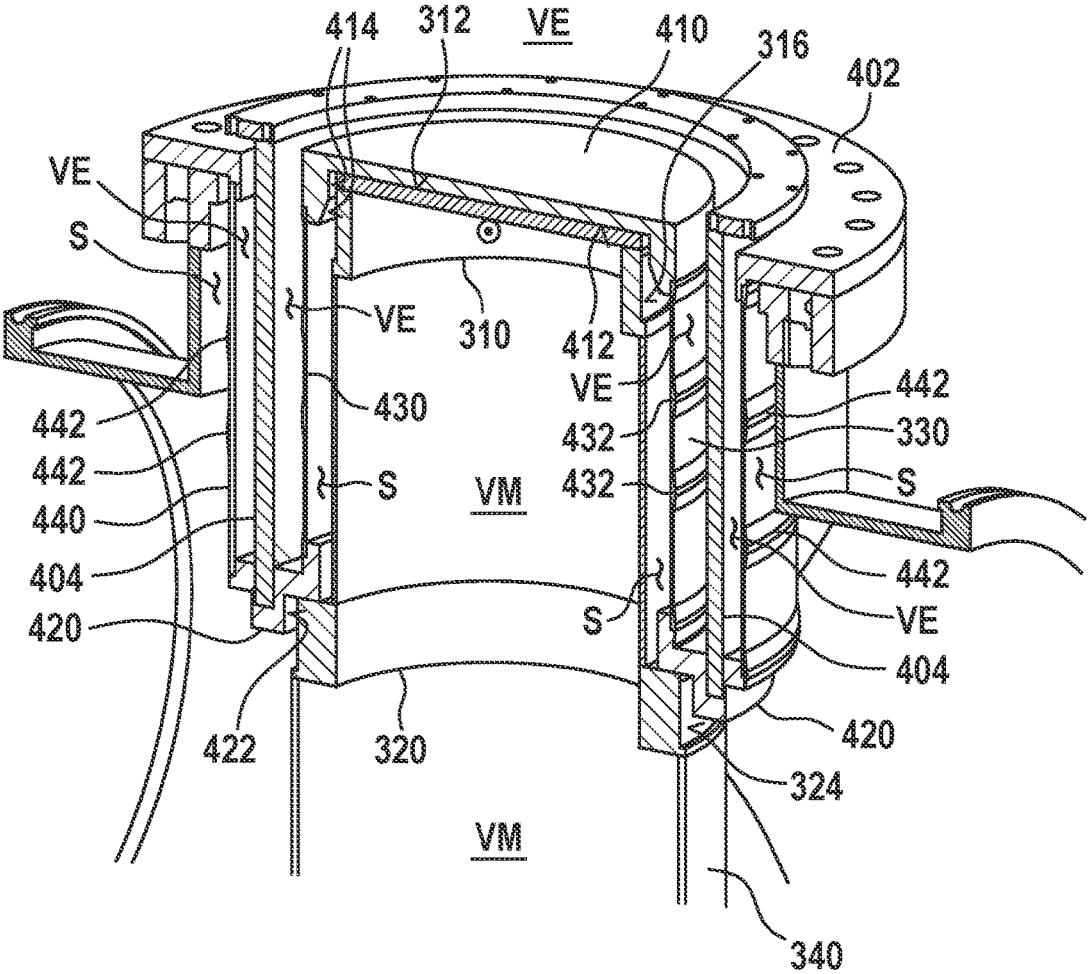
FIG. 5 shows a perspective view of the thermal interface arrangement of the cryogenic apparatus and the thermal interface arrangement of the external vacuum chamber of FIGS. 2 to 4 in a connected state.

FIG. 2 shows a cross-sectional view of a thermal interface arrangement 300 of a cryogenic apparatus and a thermal interface arrangement 400 of an external vacuum chamber in a disconnected state according to embodiments described herein. FIG. 3 shows a perspective view of the thermal interface arrangement 300 of the cryogenic apparatus and the thermal interface arrangement 400 of the external vacuum chamber of FIG. 2 in a disconnected state. FIG. 4 shows a cross-sectional view of the thermal interface arrangement 300 of the cryogenic apparatus and the thermal interface arrangement 400 of the external vacuum chamber of FIGS. 2 and 3 in a connected state. FIG. 5 shows a perspective view of the thermal interface arrangement 300 of the cryogenic apparatus and the thermal interface arrangement 400 of the external vacuum chamber of FIGS. 2 to 4 in a connected state.

The thermal interface arrangement 300 of the cryogenic apparatus and the thermal interface arrangement 400 of the external vacuum chamber are similar to the thermal interface arrangement of the cryogenic apparatus and the thermal interface arrangement of the external vacuum chamber described with reference to FIGS. 1A and 1B, and a description of similar or identical aspects is omitted in the following.

Although not shown in FIGS. 2 to 5, a vacuum vessel can be attached to a top side of the thermal interface arrangement 400, such as a flange 402 thereof, to provide a sealed space in which the vacuum VE can be established and maintained.

The thermal interface arrangement 300 of the cryogenic apparatus includes a first thermal interface 310 connectable to a third thermal interface 410 of the thermal interface arrangement 400 of the external vacuum chamber to cool the object stage (not shown) fluidly immersed in the vacuum VE. In particular, the object stage can be mechanically and thus thermally connected to the third thermal interface 410 of the thermal interface arrangement 400 to cool the object stage via the first thermal interface 310 and the third thermal interface 410.

The thermal interface arrangement 300 of the cryogenic apparatus further includes a second thermal interface 320 connectable to a fourth thermal interface 420 of the thermal interface arrangement 400 of the external vacuum chamber. When the cryogenic apparatus is connected to the external vacuum chamber, the second thermal interface 320 is connected to the fourth thermal interface 420 of the external vacuum chamber to cool at least one element within the external vacuum chamber. The at least one element within the external vacuum chamber can be a pre-cooling stage and/or a thermal shield 404.

The first thermal interface 310 and the second thermal interface 320 can be configured to be cooled to a first temperature and a second temperature, respectively. Preferably, the first temperature is lower than the second temperature. For example, the first temperature can be between 1K and 5K (e.g., about 4K) and the second temperature can be between 35K and 45K (e.g., 40K).

According to some embodiments, which can be combined with other embodiments described herein, the first thermal interface 310, the second thermal interface 320, the third thermal interface 410 and the fourth thermal interface 420 include, or are made of, a material having a high thermal conductivity. For example, the first thermal interface 310, the second thermal interface 320, the third thermal interface 410 and the fourth thermal interface 420 include a metal material, such as copper or brass.

The first thermal interface 310, the second thermal interface 320, the third thermal interface 410 and the fourth thermal interface 420 can be made of the same material or can be made of different materials.

In some embodiments, first thermal interface 310 can have a first surface 312 configured to contact a third surface 412 of the third thermal interface 410 of the external vacuum chamber when the cryogenic apparatus is connected to the external vacuum chamber. The first surface 312 can be an essentially flat surface and/or an extended surface and/or an essentially horizontal surface and/or a top surface and/or has an essentially circular shape. The third surface 412 can be an essentially flat surface and/or an extended surface and/or an essentially horizontal surface and/or a bottom surface and/or has an essentially circular shape.

The first thermal interface 310 can have at least one first contact element 314 (preferably a plurality of first contact elements 314) configured to contact the third thermal interface 410, such as a contact surface 414 of the third thermal interface 410. The contact surface 414 of the third thermal interface 410 can include a vertical surface and/or a slanted surface. The at least one first contact element 314 can be a spring element and/or can be arranged at a lateral side and/or a circumference of the first thermal interface 310, particularly an outer circumference.

Additionally, or alternatively, the third thermal interface 310 can have at least one third contact element (preferably a plurality of third contact elements; not shown) configured to contact the first thermal interface 310, such as a (contact) surface 316 of the first thermal interface 310. The (contact) surface 316 of the first thermal interface 310 can include a vertical surface and/or a slanted surface. The at least one third contact element can be a spring element and/or can be arranged at an inner circumference of the first thermal interface 310.

In some embodiments, the second thermal interface 320 can have at least one second contact element 322 (preferably a plurality of second contact elements 322) configured to contact the fourth thermal interface 420, such as a contact surface 422 of the third thermal interface 420. The contact surface 422 of the third thermal interface 420 can include a vertical surface and/or a slanted surface. The at least one second contact element 322 can be a spring element and/or can be arranged at a lateral side and/or a circumference of the second thermal interface 420.

Additionally, or alternatively, the fourth thermal interface 420 can have at least one fourth contact element (preferably a plurality of fourth contact elements; not shown) configured to contact the second thermal interface 320, such as a (contact) surface 324 of the second thermal interface 320. The (contact) surface 324 of the second thermal interface 320 can include a vertical surface and/or a slanted surface. The at least one fourth contact element can be a spring element and/or can be arranged at an inner circumference of the fourth thermal interface 420.

The term "vertical" is understood to distinguish over "horizontal". That is, "vertical" relates to an essentially vertical arrangement of the elements and/or surfaces, wherein a deviation of a few degrees, e.g., up to 100 or even up to 15°, from an exact vertical arrangement is still considered a "vertical arrangement" or "essentially vertically". The vertical direction can be essentially parallel to the force of gravity.

According to some embodiments, the third thermal interface 410 at least partially surrounds the first thermal interface 310 when the cryogenic apparatus is connected to the external vacuum chamber.

According to some embodiments, the fourth thermal interface 420 at least partially surrounds the second thermal interface 320 when the cryogenic apparatus is connected to the external vacuum chamber.

The first thermal interface 310 and the second thermal interface 320 of the cryogenic apparatus can be located at different heights, e.g., along a longitudinal axis of the first thermal interface 310 and/or the second thermal interface 320. Additionally, or alternatively, the third thermal interface 410 and the fourth thermal interface 420 of the external vacuum chamber are located at different heights, e.g., along a longitudinal axis of the third thermal interface 410 and/or the fourth thermal interface 420.

In some embodiments, the first thermal interface 310, the second thermal interface 320, the third thermal interface 410 and the fourth thermal interface 420 can have a common longitudinal axis, such as a cylinder axis if the first thermal interface 310, the second thermal interface 320, the third thermal interface 410 and the fourth thermal interface 420 have a cylindrical shape.

According to some embodiments, the cryogenic apparatus, in particular the thermal interface arrangement of the cryogenic apparatus, includes a first support structure 330 supporting the first thermal interface 310. The first support structure 300 may support the first thermal interface 310 from below. For example, the first thermal interface 310 can be attached to a top side of the first support structure 330.

The first support structure 330 can be connected to the second thermal interface 320 to support the first thermal interface 310. For example, a first end of the first support structure 330 can be connected to the first thermal interface 310 and a second end of the first support structure 330 opposite the first end can be connected to the second thermal interface 320.

The first support structure 330 can have a low thermal conductivity to minimize heat transfer between the first thermal interface 310 and the second thermal interface 320. In some embodiments, the first support structure 330 can be made of glass fiber reinforced plastics and/or can be formed as a single piece.

In some embodiments, the first support structure 330 can have a cylindrical shape. For example, the first support structure 330 may be a hollow cylinder. In some embodiments, the first thermal interface 310 can close off an upper side of the hollow cylinder, particularly essentially vacuum-tight.

The first support structure 330 may seal the vacuum VM inside the vacuum chamber of the cryogenic apparatus from an outside essentially vacuum-tight. In particular, the first support structure 330 can provide, or be, a wall of the vacuum chamber of the cryogenic apparatus.

According to some embodiments, the cryogenic apparatus, in particular the thermal interface arrangement of the cryogenic apparatus, includes a second support structure 340 supporting the second thermal interface 320. As is shown in FIGS. 2 to 5, the first support structure 330 having the first thermal interface 310 mounted thereon can be attached to a first (upper) side of the second thermal interface 320 and the second support structure 340 can be mounted to a second (bottom) side of the second thermal interface 320. Accordingly, in some embodiments, the second support structure 340 can support the second thermal interface 320, the first support structure 330 and the first thermal interface 310.

In some embodiments, the second thermal interface 320 can have a ring-shape.

The second support structure 340 can be connected to the vacuum chamber of the cryogenic apparatus or another part of the cryogenic apparatus to support at least the second thermal interface 320. The second support structure 340 can have a low thermal conductivity to minimize heat transfer to second thermal interface 320. In some embodiments, the second support structure 340 can be made of glass fiber reinforced plastics and/or can be formed as a single piece.

In some embodiments, the second support structure 340 can have a cylindrical shape. For example, the second support structure 340 may be a hollow cylinder.

The second support structure 340 may seal the vacuum VM inside the vacuum chamber of the cryogenic apparatus from an outside essentially vacuum-tight. In particular, the second support structure 340 can provide, or be, a wall of the vacuum chamber of the cryogenic apparatus.

According to some embodiments, the thermal interface arrangement 400 of the external vacuum chamber includes a third support structure 430 supporting the third thermal interface 410. The third support structure 430 may support the third thermal interface 410 from below. For example, the third thermal interface 410 can be attached to a top side of the third support structure 430.

The third support structure 430 can be connected to the fourth thermal interface 420 to support the third thermal interface 410. In particular, a first end of the third support structure 430 can be connected to the third thermal interface 410 and a second end of the third support structure 430 opposite the first end can be connected to the fourth thermal interface 420.

The third support structure 430 can have a low thermal conductivity to minimize heat transfer between the third thermal interface 410 and the fourth thermal interface 420. In some embodiments, the third support structure 430 can be made of a metal material, such as stainless steel.

In some embodiments, the third support structure 430 can have a cylindrical shape. For example, the third support structure 430 may be a hollow cylinder. In some embodiments, the third thermal interface 410 can close off an upper side of the hollow cylinder, particularly essentially vacuum-tight.

In some embodiments, the third support structure 430 includes, or is, a membrane having a thickness of 0.5 mm or less, or 0.2 mm or less. Optionally, the third support structure 430 includes one or more reinforcement ribs 432. For example, the one or more reinforcement ribs 342 can extend around a circumference of the third support structure 430, in particular horizontally. The one or more reinforcement ribs 432 increase a robustness of the third support structure 430 to vacuum forces.

The third support structure 430 can be essentially vacuum-tight. For example, the third support structure 430 may seal the vacuum VE inside the external vacuum chamber from an outside essentially vacuum-tight. The third support structure 430 may provide, or be, a wall of the external vacuum chamber.

According to some embodiments, the thermal interface arrangement 400 of the external vacuum chamber includes a fourth support structure 440 supporting the fourth thermal interface 420. The fourth support structure 440 is connected to the external vacuum chamber, e.g., via the flange 402, to support the fourth thermal interface 420, e.g., in a suspended state. In particular, a first end of the fourth support structure 440 can be connected to the flange 402 and a second end of the fourth support structure 440 opposite the first end can be connected to the fourth thermal interface 420.

The fourth support structure 440 can have a low thermal conductivity to minimize heat transfer to the fourth thermal interface 420. In some embodiments, the fourth support structure 440 can be made of a metal material, such as stainless steel.

In some embodiments, the fourth support structure 440 can have a cylindrical shape. For example, the fourth support structure 440 may be a hollow cylinder. In some embodiments, the fourth thermal interface 420 can have a ring-shape.

In some embodiments, the fourth support structure 440 includes, or is, a membrane having a thickness of 0.5 mm or less, or 0.2 mm or less. Optionally, the fourth support structure 440 includes one or more reinforcement ribs 442. For example, the one or more reinforcement ribs 442 can extend around a circumference of the fourth support structure 440, in particular horizontally. The one or more reinforcement ribs 442 increase a robustness of the fourth support structure 440 to vacuum forces.

The fourth support structure 440 can be essentially vacuum-tight. For example, the fourth support structure 440 may seal the vacuum VE inside the external vacuum chamber from an outside essentially vacuum-tight. The fourth support structure 440 may provide, or be, a wall of the external vacuum chamber.

According to some embodiments, which can be combined with other embodiments described herein, the fourth thermal interface 420 and/or an extension thereof, such as the thermal shield 404, extends between the third support structure 430 and the fourth support structure 440 from a bottom side to a top side of the third support structure 430 and the fourth support structure 440.

As shown in FIGS. 4 and 5, when the cryogenic apparatus is connected to the external vacuum chamber, the first support structure 330, the second support structure 340, the third support structure 430 and/or the fourth support structure 440 are concentrically arranged.

In some embodiments, the first thermal interface 310 extends to an outside of the vacuum chamber of the cryogenic apparatus. In particular, the first thermal interface 310 can be exposed to the outside of the vacuum chamber in a state where the external vacuum chamber is not connected to the cryogenic apparatus.

In some embodiments, the second thermal interface 320 extends to an outside of the vacuum chamber of the cryogenic apparatus. In particular, the second thermal interface 320 can be exposed to the outside of the vacuum chamber in a state where the external vacuum chamber is not connected to the cryogenic apparatus.

In some embodiments, the third thermal interface 410 extends to an outside of the external vacuum chamber. In particular, the third thermal interface 410 can be exposed to the outside of the external vacuum chamber in a state where the external vacuum chamber is not connected to the cryogenic apparatus.

In some embodiments, the fourth thermal interface 420 extends to an outside of the external vacuum chamber. In particular, the fourth thermal interface 420 can be exposed to the outside of the external vacuum chamber in a state where the external vacuum chamber is not connected to the cryogenic apparatus.

When the cryogenic apparatus is connected to the external vacuum chamber, an intermediate space S is formed between the thermal interface arrangement 300 of the cryogenic apparatus and the thermal interface arrangement 400 of the external vacuum chamber (FIGS. 4 and 5). Preferably, the intermediate space S between the thermal interface arrangement 300 of the cryogenic apparatus and the thermal interface arrangement 400 of the external vacuum chamber is sealed essentially vacuum-tight when the cryogenic apparatus is connected to the external vacuum chamber.

In some embodiments, at least one pumping port (not shown) can be provided at the intermediate space S between the thermal interface arrangement 300 of the cryogenic apparatus and the thermal interface arrangement 400 of the external vacuum chamber.

Preferably, at least one pump is connectable to the at least one pumping port to establish a vacuum in the intermediate space S between the thermal interface arrangement 300 of the cryogenic apparatus and the thermal interface arrangement 400 of the external vacuum chamber after the cryogenic apparatus has been connected to the external vacuum chamber.

Accordingly, the thermal interface arrangement 300 of the cryogenic apparatus and the thermal interface arrangement 400 of the external vacuum chamber are located in a vacuum formed in the intermediate space S. This can improve a cooling efficiency and prevent moisture from condensing at the thermal interface arrangement 300 of the cryogenic apparatus and the thermal interface arrangement 400 of the external vacuum chamber.

The vacuum formed in the intermediate space S is independent from the vacuum VM in the vacuum chamber of the cryogenic apparatus and the vacuum VE in the external vacuum chamber. In other words, three independent vacuum regions can be provided.

Figure 6:
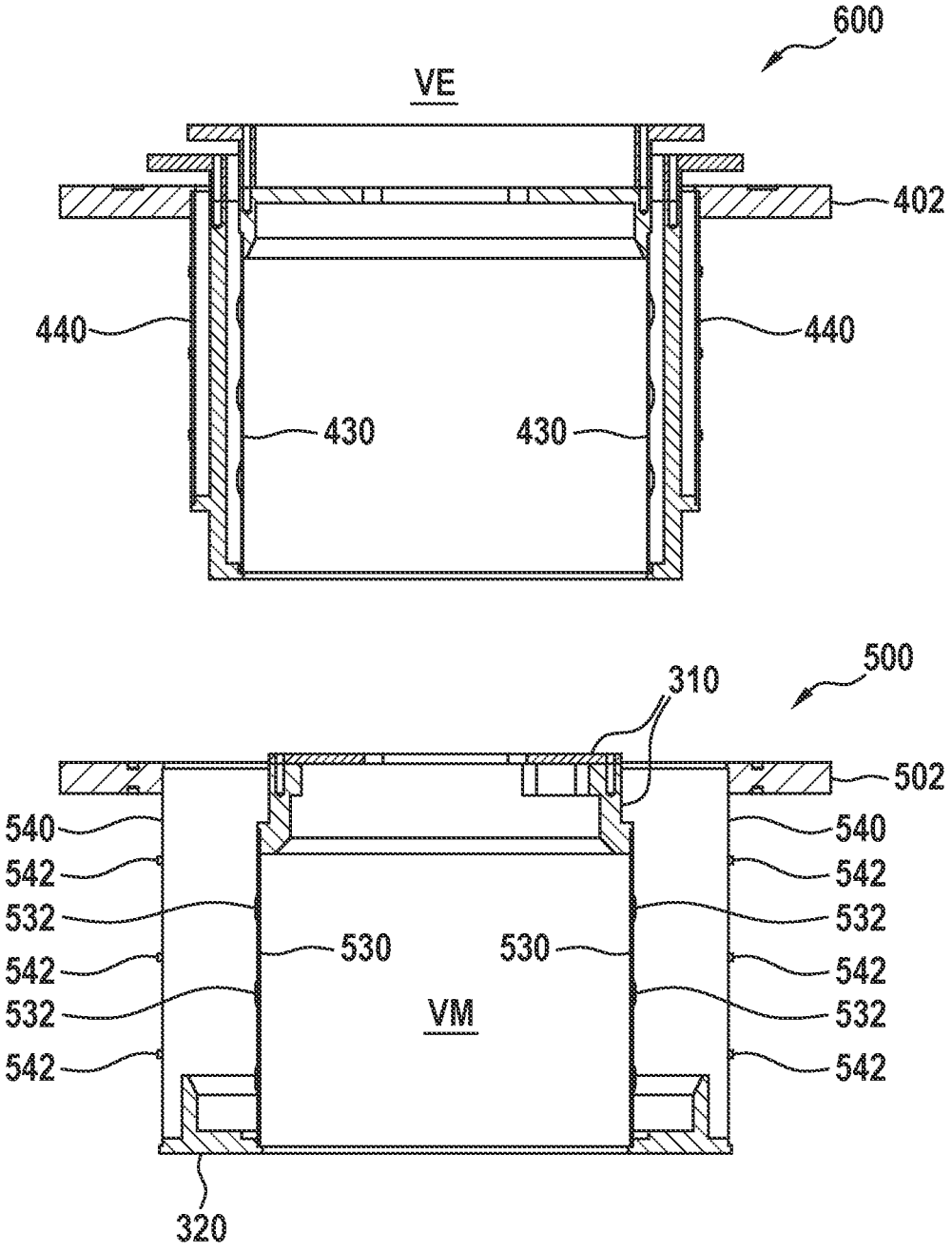
FIG. 6 shows a cross-sectional view of a thermal interface arrangement of a cryogenic apparatus and a thermal interface arrangement of an external vacuum chamber in a disconnected state according to further embodiments described herein.
Figure 7:
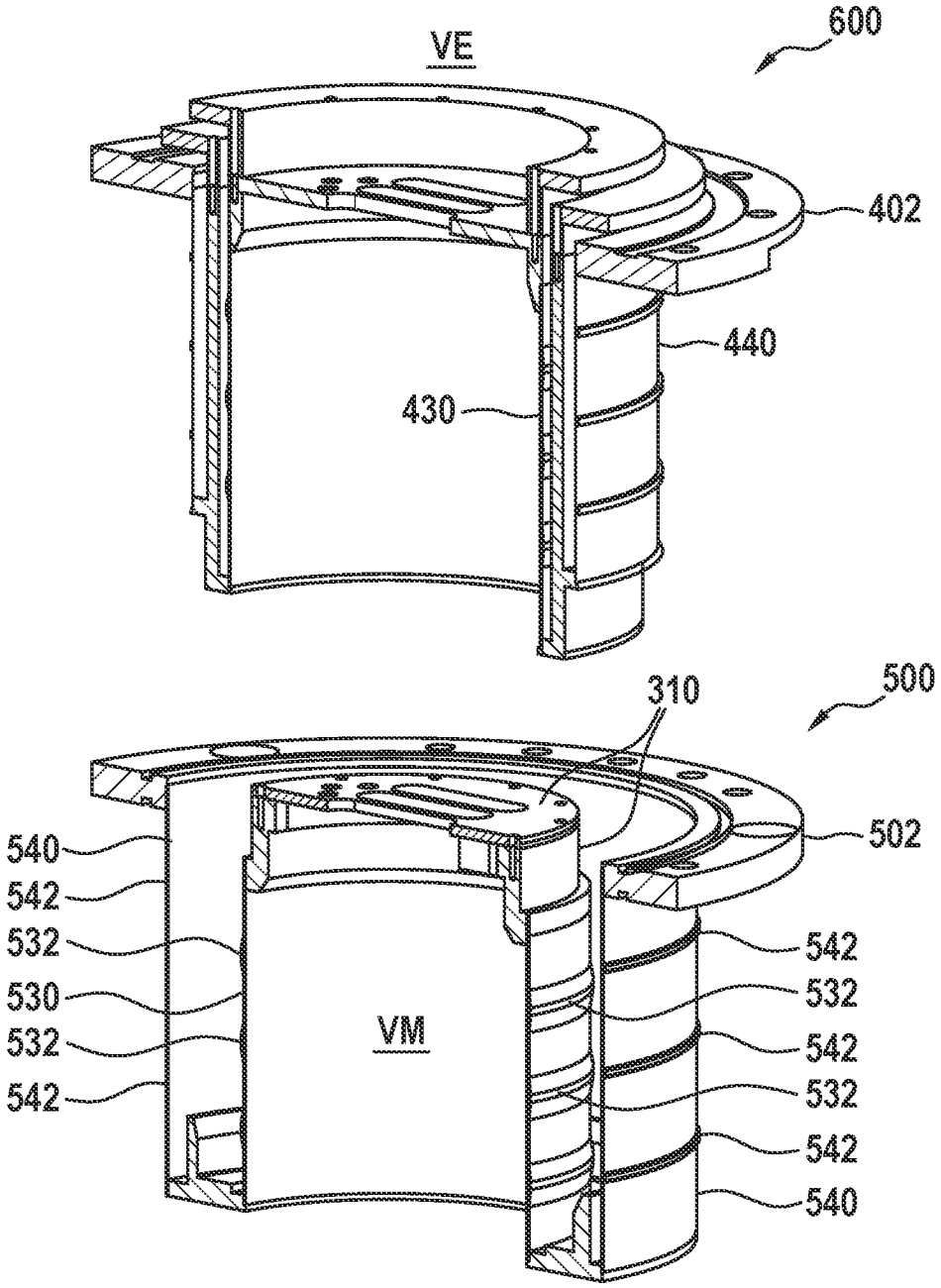
FIG. 7 shows a perspective view of the thermal interface arrangement of the cryogenic apparatus and the thermal interface arrangement of the external vacuum chamber of FIG. 6 in a disconnected state.
Figure 8:
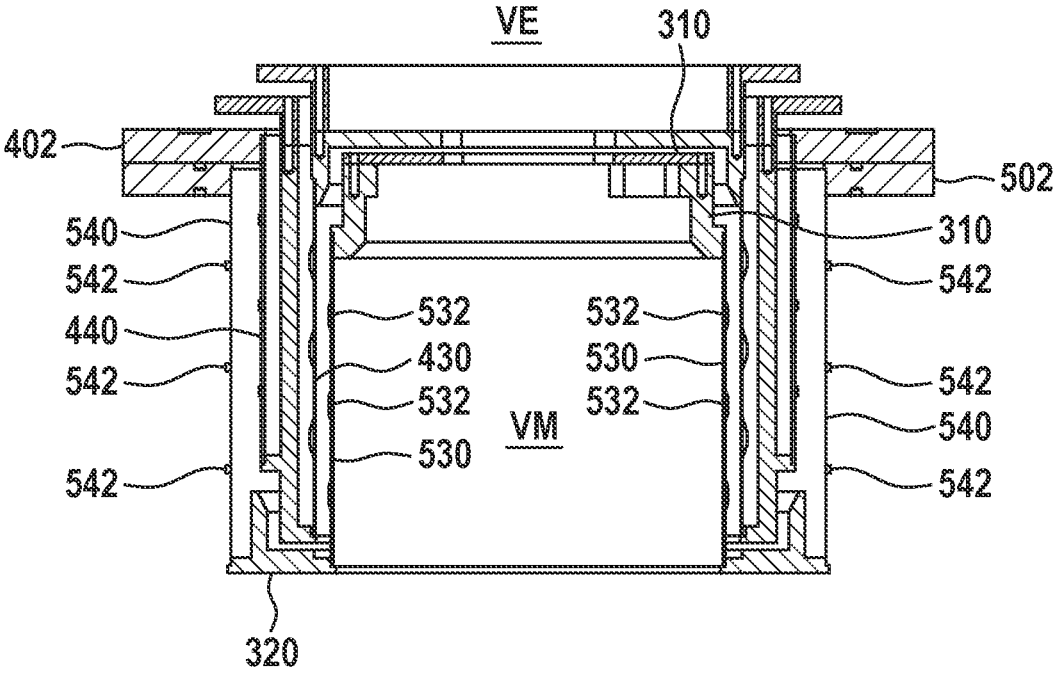
FIG. 8 shows a cross-sectional view of the thermal interface arrangement of the cryogenic apparatus and the thermal interface arrangement of the external vacuum chamber of FIGS. 6 and 7 in a connected state.
Figure 9:
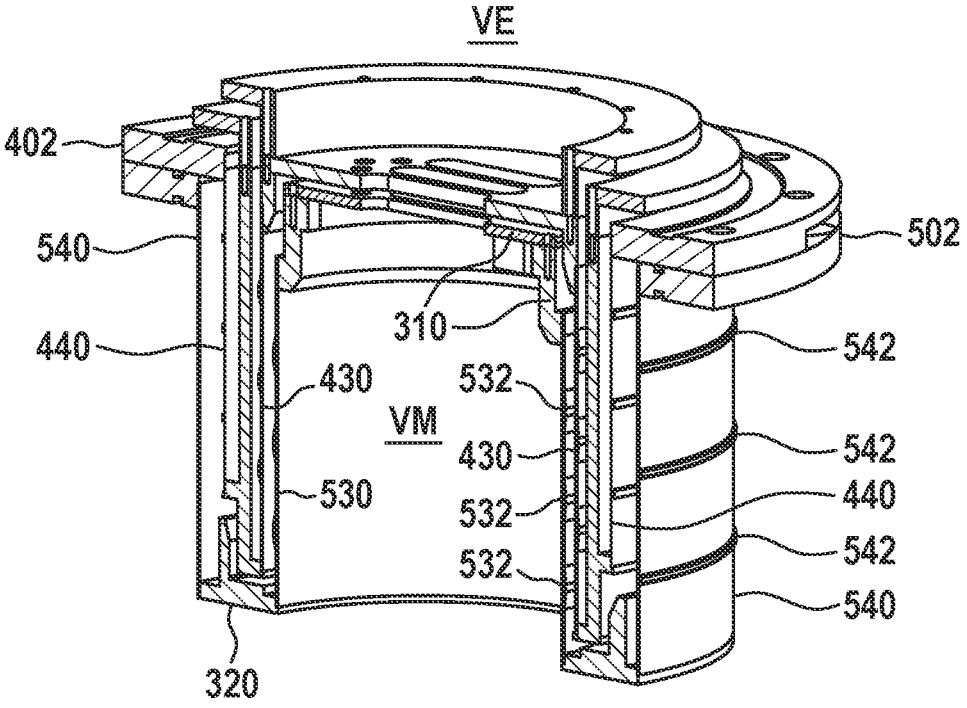
FIG. 9 shows a perspective view of the thermal interface arrangement of the cryogenic apparatus and the thermal interface arrangement of the external vacuum chamber of FIGS. 6 to 8 in a connected state.

FIG. 6 shows a cross-sectional view of a thermal interface arrangement 500 of a cryogenic apparatus and a thermal interface arrangement 600 of an external vacuum chamber in a disconnected state according to embodiments described herein. FIG. 7 shows a perspective view of the thermal interface arrangement 500 of the cryogenic apparatus and the thermal interface arrangement 600 of the external vacuum chamber of FIG. 6 in a disconnected state. FIG. 8 shows a cross-sectional view of the thermal interface arrangement 500 of the cryogenic apparatus and the thermal interface arrangement 600 of the external vacuum chamber of FIGS. 6 and 7 in a connected state. FIG. 9 shows a perspective view of the thermal interface arrangement 500 of the cryogenic apparatus and the thermal interface arrangement 600 of the external vacuum chamber of FIGS. 6 to 8 in a connected state.

Although not shown in FIGS. 6 to 9, a vacuum vessel can be attached to a top side of the thermal interface arrangement 600, such as a flange 402 thereof, to provide a sealed space in which the vacuum VE can be established and maintained.

The thermal interface arrangement 500 of the cryogenic apparatus and the thermal interface arrangement 600 of the external vacuum chamber are similar to the thermal interface arrangements described with reference to FIGS. 1 to 5, and a description of similar or identical aspects is omitted in the following.

In particular, the thermal interface arrangement 600 of the external vacuum chamber is configured similarly to the thermal interface arrangement of the external vacuum chamber described with reference to FIGS. 1 to 5.

Furthermore, the thermal interface arrangement 500 of the cryogenic apparatus differs from the thermal interface arrangement of the cryogenic apparatus described with reference to FIGS. 1 to 5 in the configuration of the first support structure and the second supporting structure.

The first support structure 530 supports the first thermal interface 310. Preferably, the first support structure 530 supports the first thermal interface 310 from below. For example, the first thermal interface 310 can be attached to a top side of the first support structure 530.

In some embodiments, the first support structure 530 is connected to the second thermal interface 320 to support the first thermal interface 310. In particular, a first end of the first support structure 530 can be connected to the first thermal interface 310 and a second end of the first support structure 530 opposite the first end can be connected to the second thermal interface 320.

Additionally, or alternatively, the first support structure 530 has a low thermal conductivity. For example, the first support structure 530 can have a thermal conductivity of 1 W/(Km) or less, or 0.5 W/(Km) or less. Thereby, the first thermal interface 310 can be thermally isolated from the second thermal interface 320.

In some embodiments, the first support structure 530 includes, or is, a membrane. The first support structure 530, such as the membrane, can have a small thickness of 0.5 mm or less, or 0.2 mm or less to lower thermal conduction. The first support structure 530 may include, or be made of, a metal material, such as stainless steel which has a low thermal conductivity. In some embodiments, the first support structure 530, such as the membrane, is formed as a single piece.

Additionally, or alternatively, the first support structure 530 has a cylindrical shape. For example, the first support structure 530 may be a hollow cylinder. In some embodiments, the first thermal interface 310 can close off an upper side of the hollow cylinder, particularly essentially vacuum-tight.

The first support structure 530 can include one or more reinforcement ribs 532. For example, the one or more reinforcement ribs 532 can extend around a circumference of the first support structure, in particular horizontally. The one or more reinforcement ribs 532 increase a robustness of the first support structure 530 to vacuum forces.

Additionally, or alternatively, the first support structure 530 is essentially vacuum-tight (particularly in combination with other walls and/or apparatus parts). For example, the first support structure 530 may seal the vacuum inside the vacuum chamber of the cryogenic apparatus from an outside essentially vacuum-tight. Preferably, the first support structure 530 provides, or is, a wall of the vacuum chamber of the cryogenic apparatus.

The second support structure 540 supports the second thermal interface 320. Preferably, the second support structure 540 supports the second thermal interface 320 from above, e.g., in a suspended state. In particular, a first end of the second support structure 540 can be connected to the vacuum chamber of the cryogenic apparatus, such as a flange 502 thereof, and a second end of the second support structure 540 opposite the first end can be connected to the second thermal interface 320. Preferably, the second thermal interface 320 has a ring-shape.

The second support structure 540 can have a low thermal conductivity. For example, the second support structure 540 can have a thermal conductivity of 1 W/(Km) or less, or 0.5 W/(Km) or less. Thereby, the second thermal interface 320 can be thermally isolated from the flange 502 which is at room temperature.

In some embodiments, the second support structure 540 includes, or is, a membrane. The second support structure 540, such as the membrane, can have a small thickness of 0.5 mm or less, or 0.2 mm or less to lower thermal conduction. The second support structure 540 may include, or be made of, a metal material, such as stainless steel which has a low thermal conductivity. In some embodiments, the second support structure 540, such as the membrane, is formed as a single piece.

Additionally, or alternatively, the second support structure 540 has a cylindrical shape. For example, the second support structure 540 may be a hollow cylinder.

The second support structure 540 can include one or more reinforcement ribs 542. For example, the one or more reinforcement ribs 542 can extend around a circumference of the first support structure, in particular horizontally. The one or more reinforcement ribs 542 increase a robustness of the second support structure 540 to vacuum forces.

Additionally, or alternatively, the second support structure 540 is essentially vacuum-tight (particularly in combination with other walls and/or apparatus parts). For example, the second support structure 540 may seal the vacuum inside the vacuum chamber of the cryogenic apparatus from an outside essentially vacuum-tight. Preferably, the second support structure 540 provides, or is, a wall of the vacuum chamber of the cryogenic apparatus.

According to some embodiments, when the cryogenic apparatus is connected to the external vacuum chamber, the first support structure 530, the second support structure 540, the third support structure 430 and the fourth support structure 440 are concentrically arranged, e.g., concentrically nested. For example, the support structures can be arranged in the following order (from the inside to the outside): first support structure 530, third support structure 430, fourth support structure 440 and second support structure 540.

Figure 10:
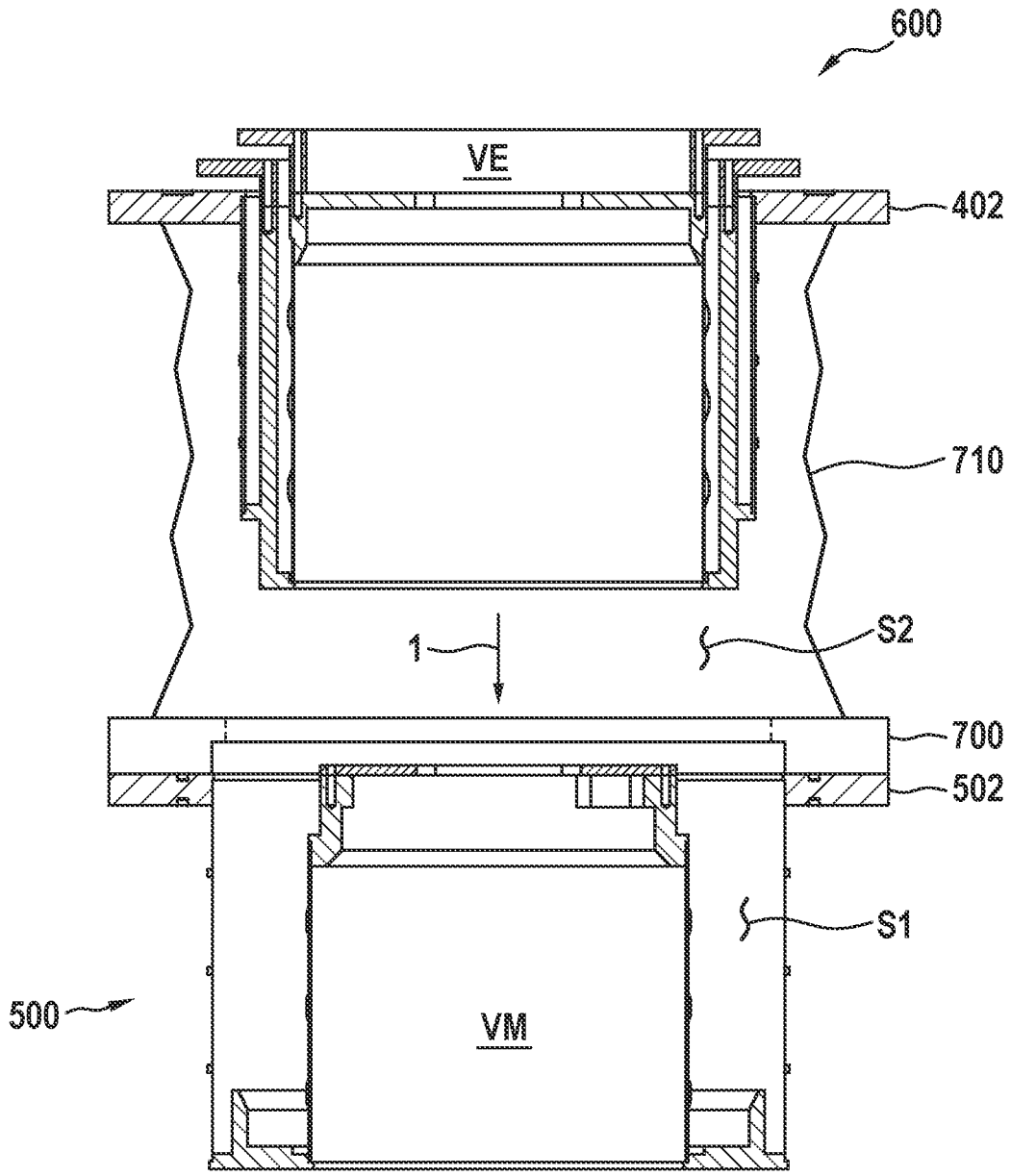
FIG. 10 shows a cross-sectional view of a thermal interface arrangement of a cryogenic apparatus and a thermal interface arrangement of an external vacuum chamber in a disconnected state according to further embodiments described herein.

FIG. 10 shows a cross-sectional view of a thermal interface arrangement of a cryogenic apparatus and a thermal interface arrangement of an external vacuum chamber in a disconnected state according to further embodiments described herein. The embodiment of FIG. 10 corresponds of the embodiment shown in FIGS. 6 to 9 with the following additions.

The cryogenic apparatus includes a valve 700 configured to close a first space S1 in which the thermal interface arrangement of the cryogenic apparatus is located. Preferably, the valve provides at least one pumping port.

The valve 70 may be closed when the cryogenic apparatus is disconnected from the external vacuum chamber. For example, a vacuum can be established in the first space S1 in which the thermal interface arrangement of the cryogenic apparatus is located when the valve 700 is closed. The valve 700 may be opened after the external vacuum chamber has been attached to the cryogenic apparatus so that the thermal interface arrangement of the external vacuum chamber can extend through the open valve 700 for being connected to the thermal interface arrangement of the cryogenic apparatus.

In more detail, the valve 700 can be closed, and a vacuum can be established or maintained in the first space S1 in which the thermal interface arrangement of the cryogenic apparatus is located. The external vacuum chamber can be attached to the cryogenic apparatus and another vacuum can be established in a second space S2 in which the thermal interface arrangement of the external vacuum chamber is located. Thereafter, the valve 400 can be opened to connect the first space S1 and the second space S2. The thermal interface arrangement of the external vacuum chamber then can be moved through the open valve 700 for connection with the thermal interface arrangement of the cryogenic apparatus (indicated with arrow 1).

According to some embodiments, a bellows 710 is connectable between the valve 700 and the thermal interface arrangement of the external vacuum chamber, such as the flange 402, to seal the second space S2 in which the thermal interface arrangement of the external vacuum chamber is located. The bellows 710 is flexible and therefore allows to move the thermal interface arrangement of the external vacuum chamber through the open valve 700 for connection with the thermal interface arrangement of the cryogenic apparatus.

In view of the above, the cryogenic apparatus is not involved in the time-consuming process of achieving high vacuum levels within the external vacuum chamber containing, for example, a scientific sample or an ion trap. Consequently, the operating efficiency of the cryogenic apparatus can be improved. For example, multiple external vacuum chambers can be prepared remotely, with an external vacuum chamber attached to the cryogenic apparatus only during measurement or testing processes and not during vacuum preparation. In addition, the external vacuum chamber may contain only components that can be heated to temperatures of 100° C. or higher to achieve high vacuum levels. Such a baking process is often not possible with cryogenic apparatuses because some components thereof cannot be heated to such high temperatures without damaging or even destroying them.

While the foregoing is directed to embodiments of the disclosure, other and further embodiments of the disclosure may be devised without departing from the basic scope thereof, and the scope thereof is determined by the claims that follow.

The invention claimed is:

1. A cryogenic apparatus, comprising:

a vacuum chamber;

a cooling arrangement in the vacuum chamber; and a thermal interface arrangement at the vacuum chamber and configured to be cooled by the cooling arrangement, wherein the cryogenic apparatus is connectable to an external vacuum chamber in a state where a vacuum is present in the external vacuum chamber, wherein, when the cryogenic apparatus is connected to the external vacuum chamber, the thermal interface arrangement of the cryogenic apparatus is connected to a thermal interface arrangement of the external vacuum chamber to cool an object stage within the external vacuum chamber by operation of the cooling arrangement, wherein the thermal interface arrangement of the cryogenic apparatus includes:

a first thermal interface connectable to a third thermal interface of the thermal interface arrangement of the external vacuum chamber to cool the object stage within the external vacuum chamber by operation of the cooling arrangement; and a second thermal interface connectable to a fourth thermal interface of the thermal interface arrangement of the external vacuum chamber, and the cryogenic apparatus further comprising a first support structure configured to support the first thermal interface and a second support structure supporting the second thermal interface, the first support structure having a first end connected to the first thermal interface and a second end that is opposite to the first end connected to the second thermal interface.

2. The cryogenic apparatus of claim 1, wherein:

the cryogenic apparatus is connectable to the external vacuum chamber in a state where a vacuum is present in the vacuum chamber of the cryogenic apparatus; and/or the cryogenic apparatus and the external vacuum chamber are detachable from each other in a state where the vacuum is present in the external vacuum chamber and/or in a state where the vacuum is present in the vacuum chamber of the cryogenic apparatus; and/or the vacuum in the vacuum chamber of the cryogenic apparatus is a main thermal isolation vacuum; and/or the cooling arrangement is fluidly immersed in the vacuum in the vacuum chamber of the cryogenic apparatus; and/or the vacuum chamber of the cryogenic apparatus is separate from the external vacuum chamber, wherein the vacuum chamber of the cryogenic apparatus and the external vacuum chamber do not have a common chamber wall.

3. The cryogenic apparatus of claim 1, wherein:

the second thermal interface is configured to be cooled by the cooling arrangement or another cooling arrangement of the cryogenic apparatus, and when the cryogenic apparatus is connected to the external vacuum chamber, the second thermal interface is connected to the fourth thermal interface of the external vacuum chamber to cool at least one element within the external vacuum chamber by operation of the cooling arrangement or the another cooling arrangement; and/or the first thermal interface and the second thermal interface are configured to be cooled to a first temperature and a second temperature, respectively, wherein the first temperature and the second temperature are different; and/or the cooling arrangement includes a cryogen-free closed cycle system.

4. The cryogenic apparatus of claim 1, wherein:

the first thermal interface has a first surface configured to contact a third surface of the third thermal interface of the external vacuum chamber when the cryogenic apparatus is connected to the external vacuum chamber, wherein the first surface is an essentially flat surface and/or an extended surface and/or has an essentially circular shape and/or is an essentially horizontal surface and/or is a top surface; and/or the first thermal interface has at least one first contact element configured to contact the third thermal interface and/or the first thermal interface is configured to contact at least one third contact element of the third thermal interface.

5. The cryogenic apparatus of claim 1, wherein:

the third thermal interface at least partially surrounds the first thermal interface; and/or the first thermal interface and the second thermal interface of the cryogenic apparatus are located at different heights; and/or the second thermal interface has at least one second contact element configured to contact the fourth thermal interface and/or the second thermal interface is configured to contact at least one fourth contact element of the fourth thermal interface.

6. The cryogenic apparatus of claim 1, wherein:

the first support structure is connected to the second thermal interface to support the first thermal interface; and/or the first support structure has a low thermal conductivity; and/or the first support structure has a cylindrical shape; and/or the first support structure includes, or is, a membrane; and/or the first support structure includes one or more reinforcement ribs; and/or the first support structure is made of a metal; and/or the first support structure is formed as a single piece; and/or the first support structure is vacuum-tight.

7. The cryogenic apparatus of claim 1, wherein:

the second support structure is connected to the vacuum chamber to support the second thermal interface; and/or the second support structure has a low thermal conductivity; and/or the second support structure has a cylindrical shape; and/or the second support structure includes, or is, a membrane; and/or the second support structure includes one or more reinforcement ribs; and/or the second support structure is made of a metal; and/or the second support structure is formed as a single piece; and/or the second support structure is vacuum-tight.

8. The cryogenic apparatus of claim 1, wherein:

the first thermal interface extends to an outside of the vacuum chamber, wherein the first thermal interface is configured to be exposed to the outside of the vacuum chamber in a state where the external vacuum chamber is not connected to the cryogenic apparatus; and/or the second thermal interface extends to an outside of the vacuum chamber, wherein the second thermal interface is configured to be exposed to the outside of the vacuum chamber in a state where the external vacuum chamber is not connected to the cryogenic apparatus.

9. The cryogenic apparatus of claim 1, wherein:

the cryogenic apparatus is connectable to the external vacuum chamber by a linear motion of the external vacuum chamber with respect to the cryogenic apparatus which is stationary; and/or the cryogenic apparatus is connectable to the external vacuum chamber without rotary movement; and/or the cryogenic apparatus is connectable to the external vacuum chamber in a state where the cooling arrangement is operated.

10. A cryogenic apparatus, comprising:

a vacuum chamber;

a cooling arrangement in the vacuum chamber; and a first thermal interface that is removably connectable to a third thermal interface of an external vacuum chamber to cool an object stage within the external vacuum chamber by operation of the cooling arrangement;

a second thermal interface that is removably connectable to a fourth thermal interface of the external vacuum chamber;

a first support structure configured to support the first thermal interface; and a second support structure configured to support the second thermal interface, the first support structure having a first end connected to the first thermal interface and a second end that is opposite to the first end connected to the second thermal interface.

11. The cryogenic apparatus of claim 10, wherein the cooling arrangement is fluidly immersed in a vacuum in the vacuum chamber.

12. The cryogenic apparatus of claim 10, wherein the first thermal interface is connectable to and/or detachable from the third thermal interface of the external vacuum chamber when a vacuum is present in the vacuum chamber.

13. The cryogenic apparatus of claim 10, wherein the second thermal interface is connectable to the third thermal interface of the external vacuum chamber to cool at least one element within the external vacuum chamber by operation of the cooling arrangement.

14. The cryogenic apparatus of claim 10, wherein the first thermal interface is configured to extend to outside of the vacuum chamber when not connected to the third thermal interface and/or wherein the second thermal interface is configured to extend to outside of the vacuum chamber when not connected to the fourth thermal interface.

15. The cryogenic apparatus of claim 10, wherein the first and second thermal interfaces are removably connectable to the third and fourth thermal interfaces, respectively, by a linear motion or a non-rotary motion.

16. The cryogenic apparatus of claim 10, wherein the first thermal interface comprises a first contact surface that has a flat, circular shape and a second contact surface that has a ring shape.

17. The cryogenic apparatus of claim 16, wherein the second thermal interface comprises a contact surface that has a ring shape.

* * * * *